US009371641B2

(12) United States Patent
Christensen et al.

(10) Patent No.: US 9,371,641 B2
(45) Date of Patent: Jun. 21, 2016

(54) CONSTRUCTION-UNIT FOR IMMEDIATE OR PERMANENT SHELTER

(71) Applicant: EverShelter ApS, Randers Sv (DK)

(72) Inventors: Jakob Christensen, Randers Sv (DK); Claus Ove Heding, Mørke (DK)

(73) Assignee: EverShelter ApS, Randers Sv (DK)

( * ) Notice: Subject to any disclaimer, the term of this patent is extended or adjusted under 35 U.S.C. 154(b) by 0 days.

(21) Appl. No.: 14/355,605

(22) PCT Filed: Oct. 12, 2012

(86) PCT No.: PCT/DK2012/050384

§ 371 (c)(1),
(2) Date: May 1, 2014

(87) PCT Pub. No.: WO2013/064150

PCT Pub. Date: May 10, 2013

(65) Prior Publication Data

US 2014/0290153 A1 Oct. 2, 2014

(30) Foreign Application Priority Data

Nov. 2, 2011 (DK) ..... 2011 000847

(51) Int. Cl.
*E04B 1/32* (2006.01)
*E04H 1/12* (2006.01)
(Continued)

(52) U.S. Cl.
CPC ..... *E04B 1/32* (2013.01); *E04B 1/3205* (2013.01); *E04B 1/40* (2013.01); *E04C 2/10* (2013.01);
(Continued)

(58) Field of Classification Search
CPC ..... E04B 1/32; E04B 1/3211; E04B 7/08; E04B 2001/3276; E04B 1/3205; E04B 2001/3252; E04B 1/1903; E04B 2001/3241; E04B 1/3583; E04B 1/2604; E04B 2001/268; E04C 3/38; E04C 2/32; E02D 11/18; E02D 11/20
USPC ..... 52/86–88, 80.1, 80.2, 81.1, 81.2, 81.4, 52/81.6, 247, 274, 79.1, 79.4, 79.5, 79.6, 52/79.9, 231; 405/126
See application file for complete search history.

(56) References Cited

U.S. PATENT DOCUMENTS 876,985 A * 1/1908 Malancon ..... 52/585.1
2,351,209 A 6/1944 Hobbs
(Continued)

FOREIGN PATENT DOCUMENTS

BE 458067 A 11/1945
CH 203898 A 4/1939
GB 1178261 A 1/1970

OTHER PUBLICATIONS

International Search Report and Written Opinion of PCT/DK2012/050384, mailed Mar. 21, 2013.

*Primary Examiner* — Beth Stephan
(74) *Attorney, Agent, or Firm* — Dinsmore & Shohl LLP

(57) ABSTRACT

A construction-unit (23) that is adapted for being combined with one more similar units (23) to constitute a self-carrying structure (40) to use for shelter or dwelling wherein each construction-unit (23) make up for both one sidewall and half a roof in one segment. A plurality of construction-units (23) are adapted for constructing a static functional self-carrying structure (40) where the shape has a curved design related to the mathematical expression The Hyperbolic Cosine or part of an Ellipse in the traverse direction and a linear design in the longitudinal direction when placed as a part of an assembled shelter (40).

7 Claims, 24 Drawing Sheets

(51) Int. Cl.

| | |
|---|---|
| ***E04H 15/36*** | (2006.01) |
| ***E04B 1/41*** | (2006.01) |
| ***E04C 2/10*** | (2006.01) |
| *E04B 1/35* | (2006.01) |

(52) U.S. Cl.
CPC ..... *E04H 1/1205* (2013.01); *E04H 15/36* (2013.01); *E04B 2001/3276* (2013.01); *E04B 2001/3288* (2013.01); *E04B 2001/3583* (2013.01)

(56) References Cited

U.S. PATENT DOCUMENTS

| | | | | | |
|---|---|---|---|---|---|
| 3,284,969 | A | * | 11/1966 | Walters et al. | 52/81.4 |
| 4,068,423 | A | * | 1/1978 | Marsh | 52/86 |
| 4,649,676 | A | * | 3/1987 | Davey | 52/86 |
| 4,745,713 | A | * | 5/1988 | Gotoh | 52/89 |
| 4,785,605 | A | * | 11/1988 | Jenn | 52/745.08 |
| 4,885,879 | A | * | 12/1989 | Plantier | 52/63 |
| 4,887,397 | A | * | 12/1989 | Peterson | 52/86 |
| 5,233,799 | A | * | 8/1993 | Abukawa | 52/86 |
| 5,323,573 | A | * | 6/1994 | Bakewell, III | 52/86 |
| 5,385,423 | A | * | 1/1995 | Abukawa | 403/245 |
| 5,611,178 | A | * | 3/1997 | Aubert | 52/169.6 |
| 6,161,342 | A | * | 12/2000 | Barbier et al. | 52/86 |
| 6,205,605 | B1 | * | 3/2001 | Orsat | 14/26 |
| 6,243,994 | B1 | * | 6/2001 | Bernini | 52/86 |
| 6,474,907 | B2 | * | 11/2002 | Semotiuk et al. | 405/126 |
| 6,679,009 | B2 | * | 1/2004 | Hotes | 52/86 |
| 6,898,903 | B1 | * | 5/2005 | Thomas | 52/86 |
| 7,562,497 | B2 | * | 7/2009 | Warren | 52/86 |
| 2002/0017068 | A1 | * | 2/2002 | Monachino | 52/247 |
| 2003/0177715 | A1 | * | 9/2003 | Dunson et al. | 52/86 |
| 2006/0207191 | A1 | * | 9/2006 | Sutton | 52/4 |
| 2009/0025306 | A1 | * | 1/2009 | Reed | 52/80.1 |
| 2010/0126093 | A1 | * | 5/2010 | Davis et al. | 52/283 |
| 2010/0313490 | A1 | * | 12/2010 | Park et al. | 52/80.1 |
| 2011/0271607 | A1 | * | 11/2011 | Saura Garcia et al. | 52/63 |

* cited by examiner

CONSTRUCTION-UNIT FOR IMMEDIATE OR PERMANENT SHELTER

CROSS-REFERENCE TO RELATED APPLICATIONS

This application is the U.S. National Phase of PCT/DK2012/050384 filed Oct. 12, 2012, which claims priority of Danish Patent Application PA 2011 000847 filed Nov. 2, 2011.

FIELD OF THE INVENTION

The present invention relates to a construction-unit as a solution to the problem of resettlement of displaced or poor populations.

BACKGROUND OF THE INVENTION

One of the most pressing worldwide problems, with regards to construction, is the widespread shortage of family housing in poor countries.

Natural disasters have repeatedly contributed to declining conditions for many already poor populations. Development of a housing construction method that is fast, efficient and appropriate is, therefore, of great importance.

SUMMARY OF THE INVENTION

With the previously described background in mind, it is a huge advantage that the homes being built for house disaster victims are well insulated and cost-efficient as regards the used materials. Designing these dwellings to withstand future natural disasters is critical.

The simplicity of the light-weight constructing method involves the recipients and demands only very simple instructions.

The production process can take place locally in order to involve local entrepreneurs and help local economic growth.

The proposed solution can have particular relevance in cold and inaccessible territories and can also be very suitable for use in areas threatened by earthquakes or in those areas where wood and steel are in short supply.

The present invention relates to a construction-unit that is adapted for being combined with one more similar unit to constitute a self-carrying structure to use for shelter or dwelling wherein each construction-unit make up for both one sidewall and half a roof in one segment.

The units may be shaped as half an arch and can be joined with a similar unit to make a whole self-carrying shelter.

The shelter can, in an emergency situation, be used as a temporary or transitional insulating shelter.

Due to its light weight the shelter can easily be transported to another location to be placed on a plinth to be used as the primary part of the building envelope of a permanent house.

BRIEF DESCRIPTION OF THE INVENTION

The unique aims for the invention are to avoid transitional waste and to avoid future slum.

Too many shelter solutions consist of emergency tents or transitional housing materials that turn into waste after a relatively short life. The invention is both economically and environmentally attractive as they can be reused for permanent dwellings.

The concept inspires housing construction method away from the typical corrugated iron-sheeted roof-structures that architecturally defines slum. By integrating local materials such as clay or lime-stone, it is possible to plaster the shelter until it has a more permanent solid structure.

The present invention relates to a construction-unit that is adapted for being combined with one more similar unit to constitute a self-carrying structure to use for shelter or dwelling wherein each construction-unit make up for both one sidewall and half a roof in one segment and where the weight is less than 75 kg. The self-carrying structure can be obtained by placing the two similar units rotated 180 degrees relative to each other in a horizontal plane and making them face each other at their top. This means that when two construction-units are joined they can transfer static and dynamic loads to the base. A limited weight makes it easy to handle without machinery.

In an embodiment of the invention the weight is less than 60 kg.

In an embodiment of the invention the weight is less than 50 kg.

In an embodiment of the invention the weight is less than 25 kg.

In an embodiment of the invention the weight is less than 20 kg.

In an embodiment of the invention the weight is less than 15 kg.

In an embodiment of the invention at least 30% of the volume consists of polymer. The use of polymer can in an expanded version secure a low weight in relation to the volume which is an advantage when handling the construction-units. Expanded polymer also secure a high insulating effect in order to obtain a warm indoor climate when used for housing. Polymer can in a harder version give a high strength.

In an embodiment of the invention at least 40% of the volume consists of polymer.

In an embodiment of the invention at least 60% of the volume consists of polymer.

In an embodiment of the invention at least 80% of the volume consists of polymer.

In an embodiment of the invention at least 90% of the volume consists of polymer.

In an embodiment of the invention the main constituent is a material-composition based on polymers such as polyurethane or polystyrene. The fabrication of construction-units of polyurethane is basically a process of mixing the two-part composite and filling the mixed liquid into a separable mold right after mixing it. This solution demands certain procedures of production that relates to security of handling Polyurethane. It is important to make the mold able to stand up to the forces within the expanding polyurethane. In an embodiment of the invention the material-composition may include or be based on other organic or synthetic materials.

In an embodiment of the invention the main constituent is a cement-based material-composition such as polystyrene concrete or aerated concrete. This combination can make the unit insulating towards cold, heat or sound. The combination of materials can contribute to making the unit light in weight and thereby possibly manageable with only manpower and without machinery. If using expanded polystyrene with cement a buoyancy-restricting additive is added to the polystyrene to prevent it from seeking towards the top in the unhardened mixture. The material-composition may include clay, mud, dirt, limestone, chalk or ash combined with other organic or synthetic materials. In an embodiment of the invention there are multiple horizontal holes in the longitudinal direction of the construction-unit for ventilating the unit to avoid problems caused by moisture.

In an embodiment of the invention the thickness of the construction-unit may be between 10 mm and 600 mm.

In an embodiment of the invention the thickness of the construction-unit may be between 10 mm and 400 mm.

In an embodiment of the invention the thickness of the construction-unit may be between 10 mm and 200 mm.

In an embodiment of the invention the thickness of the construction-unit may be between 10 mm and 100 mm.

In an embodiment of the invention the thickness of the construction-unit may be between 1 mm and 50 mm.

In an embodiment of the invention the construction-unit is adapted for being assembled with a similar construction-unit in a direction perpendicular to the span of the self-carrying structure in a horizontal plane by having tongue or groove or by using an assembling-unit that fits into holes, grooves or dents in the side of the construction-units that has contact after being assembled.

In an embodiment of the invention the construction-unit is adapted for being assembled and tightened together with multiple similar construction-units by leading tension-bars through precast horizontal holes in the construction-units. When a desired number of units have been assembled the units can be tautened by making threads at the end of the previously described tension-bars and fasten with nuts and washers.

In an aspect of the invention the static functional shaping of the construction-unit when in use is related to a curved design in the direction where two construction-units form a span when they are combined to constitute a self-carrying structure and in relation to that direction form a linear design in the perpendicular direction in a horizontal plane when placed as a part of an assembled shelter.

In an aspect of the invention the upright position of the construction-unit is obtained when in use by connecting it with a similar construction-unit at their top by letting a groove in the top of the construction-units enclose a pole, a pipe or a band or by fitting into a profile-beam.

In an aspect of the invention the horizontal static forces at the lowest part of the construction-unit in the direction where two construction-units form a span when they are combined to constitute a self-carrying structure can be adapted by a frame or a band that is both able to fix the lowest part of the construction-unit and is also able to be fixed on to a foundation, plinth or a wall. Alternatively the construction-units can be placed and possibly there is made a tongue on the top of the plinth to fit into a groove in the bottom of the construction-units. Another way to absorb horizontal forces is to connect supports in the transverse direction by for either bars, wires, rafters or poles.

In an aspect of the invention the horizontal static forces, at the top of the construction-unit in the direction of the span of the self-carrying, can be adapted by connecting the two similar construction-units with a rope or a steel wire that is twisted around a tension-bar running through holes in the construction-units.

In an aspect of the invention the horizontal static forces, at the top of the construction-unit in the direction of the span of the self-carrying, can be adapted by connecting the two similar construction-units with a plate consisting of metal or polymer placed right under a top-tube and provided with holes that secure passage of the tension-bar running through holes in the construction-units.

In an aspect of the invention the stability can be increased by a stabilizing wall placed in the direction where two construction-units form a span when they are combined to constitute a self-carrying structure.

In an aspect of the invention the stability can be increased by a stabilizing wall placed in the direction where two construction-units form a span when they are combined to constitute a self-carrying structure and fixed with a band that grabs the wall and fix the wall between the construction-units at the same time.

In an aspect of the invention where it is possible to place the wall under the assembled shelter at any desired connection between the construction-units.

In an aspect of the invention the wall has the same material-composition as the construction-unit.

In an aspect of the invention the wall consists of multiple wall-units that can be assembled by having tongue or groove or by using an assembling-unit that fits into holes, grooves or dents in the side of the wall-units that has contact after being assembled.

In an aspect of the invention it relates to the use of a plurality of construction-units as described above for constructing a static functional self-carrying structure the shape which has a curved design related to the mathematical expression The Hyperbolic Cosine or part of an Ellipse in the transverse direction and a linear design in the longitudinal direction when placed as a part of an assembled shelter. The construction-unit can be designed as an optimal compression-arch that minimizes inner bending moments from evenly distributed static or dynamic loads. A version of the construction-unit refers to the shape of a hanging chain rotated 180 degrees in a vertical plane. The unit can have a varying curvature with a decreasing radius in the vertical plane towards its top. Another version of the construction-unit could be shaped angular, circular, elliptic or with another variation of curvature In an aspect of the invention the self-carrying structure to be used for shelter or dwelling which structure comprises two or more construction-units.

In an aspect of the invention a self-carrying structure according to any of the preceding claims, which structure is placed on a foundation, plinth or a wall to be part of a permanent construction or dwelling. If the construction-units are placed on a plinth, the units can be secured to the base by tightening steel straps that may be cast into the plinth or mounted later. The plinth can be designed as a composition of multiple layers or as a one material-composition. The permanent structure must in all cases be able to obtain and transfer static and dynamic loads to the ground according to applicable regulations.

In an aspect of the invention the top of the wall has a ventilation-unit. The ventilation-unit can turn out very convenient in certain climate condition. Ventilation of the construction can be obtained by leaving holes in the top of the end-walls secured with insect net. The holes for ventilation in the end-walls could be either functioning as natural or mechanical ventilation.

In an aspect of the invention the connection between the construction-units is supported by a beam of steel, metal, cement or polymer.

In an aspect of the invention the construction-units are tightened together in the direction perpendicular to the span of the self-carrying structure in a horizontal plane by rope, wire or tension bars going from one end to the other in same direction.

In an aspect of the invention the construction-units are tightened together by rope or wire going from an end piece one end made from either wood, cement, metal or polymer to a similar end-piece in the other end of the shelter.

In an aspect of the invention the wire or rope used for tightening the construction-units towards each other is hidden within holes inside the construction-units.

In an aspect of the invention is used as a part of a cabin for sanitary installation such as toilets, latrines, zincs or baths.

In an aspect of the invention it is used for storage of for example food or medicine.

In an aspect of the invention the assembled structure is covered with roofing felt, metal sheeting or a cloth containing cement.

In an aspect of the invention the assembled structure is covered with a tarpaulin and possibly secured on both sides with sand, stones or sandbags placed on the tarpaulin or by a tension band secured to the ground. The self-carrying structure can provide immediate shelter. For a temporary immediate version of the shelter the loads can be led to the supports by for example fixing the whole assembled shelter by wrapping it with tarpaulins and fixing these with sandbags that are put on the outside to secure both vertical and horizontal movements. The construction can be water-tightened by adding waterproof coating, tape or cover onto the surface of the outside of the structure. The construction could also have a separate waterproof cover that might be placed with a little distance from the surface of the construction.

In an aspect of the invention, the top of the stabilizing wall has a ventilation-unit.

In an aspect of the invention, the ventilation-unit comprises a solid frame, which is formed to follow a curve of the construction-units from which the self-carrying structure is composed.

In an aspect of the invention the structure normally made from two construction-units is created integrally in one unit that makes up for both two side-walls and one roof.

LIST OF DRAWINGS

In the following, a few embodiments of the invention are described and explained with more details with reference to the drawing, where FIG. 1 illustrates a three-dimensional view of the assembled construction in a version consisting of sixteen construction-units in order to indicate the longitudinal and the transverse direction of the construction placed as when in use, FIG. 2 illustrates a cross-section in a vertical plane in the transverse direction of a construction-unit, FIG. 3 illustrates a cross-section in an arbitrary plane in the longitudinal direction and perpendicular to a tangent of the curve of a construction-unit, FIG. 4 illustrates a three-dimensional view of a construction-unit from a chosen viewpoint where the position of the construction-unit is turned 0 degrees in a horizontal plane, FIG. 5 illustrates a three-dimensional view of a construction-unit from a chosen viewpoint where the position of the construction-unit is turned 90 degrees in a horizontal plane, FIG. 6 illustrates a three-dimensional view of a construction-unit from a chosen viewpoint where the position of the construction-unit is turned 180 degrees in a horizontal plane, FIG. 7 illustrates a three-dimensional view of a construction-unit from a chosen viewpoint where the position of the construction-unit is turned 270 degrees in a horizontal plane, FIG. 8 illustrates a three-dimensional view of two similar construction-units joined in the longitudinal direction, FIG. 9 illustrates a three-dimensional view of two similar construction-units that have been joined in order to assemble them in the longitudinal direction, FIG. 10 illustrates a three-dimensional view of two similar construction-units being put together in the transverse direction, FIG. 11 illustrates a three-dimensional view of two similar construction-units joined in the transverse direction, FIG. 12 illustrates a three-dimensional view of a construction-unit that reveals the one of two parts of an assembling-method, FIG. 13 illustrates a three-dimensional view of a construction-unit that reveals the second of two parts of an assembling-method, FIG. 14 illustrates a three-dimensional view of two units being brought together to connect by a possible assembling method, FIG. 15 illustrates a three-dimensional view of multiple construction-units connected by the possible assembling method, FIG. 16 illustrates a three-dimensional view of how multiple construction-units are added the opportunity to be tightened together in the longitudinal direction by putting tension-bars through the holes precast in the construction-units, FIG. 17 illustrates a three-dimensional view of how a version of multiple construction-units can be tightened together in the longitudinal direction, FIG. 18 illustrates a cutout part the of top of the cross-section shown on FIG. 1 that reveals a possible solution of composite layers of the construction unit, FIG. 19 illustrates a cutout part the of top of the cross-section that reveals a possible solution of composite layers of the construction-unit, FIG. 20 illustrates a band that is able to makes a hidden fixed connection between the construction-units and a wall put up in the transverse direction of the shelter, FIG. 21 illustrates a band that is connected into the grooves of a wall put up in the transverse direction of the shelter, FIG. 22 illustrates how tour basic parts makes it possible to make a hidden fixed connection between the wall and the construction-units, FIG. 23 illustrates how it is possible to make a hidden fixed connection between the wall and the construction-units, FIG. 24 illustrates how it is possible to make a hidden fixed connection between the wall and the construction-units, FIG. 25 illustrates a three-dimensional view of two similar construction-units being able to join in the longitudinal direction by enclosing a series of assembling units, FIG. 26 illustrates a three-dimensional view of two similar construction-units joined in the longitudinal direction by enclosing a series of assembling units, FIG. 27 illustrates a three-dimensional view of two similar construction-units being able to join in the longitudinal direction by enclosing an assembling unit, FIG. 28 illustrates a three-dimensional view of two similar construction-units joined in the longitudinal direction by enclosing an assembling unit leaving only a part of the assembling-unit visible, FIG. 29 illustrates a three-dimensional view of the three separate parts that becomes an assembling unit when joined, FIG. 30 illustrates a three-dimensional view of the three separate parts that has been joined to become an assembling unit, FIG. 31 illustrates a three-dimensional view of a series of assembling-units attached to a construction-unit its holes going in the longitudinal direction, FIG. 32 illustrates a profile-band with a raised mid-section that can be used for fixing the construction-unit in the horizontal transverse direction of the shelter, FIG. 33 illustrates an assembling of a profile-band and a construction-unit, FIG. 34 illustrates a series of construction-units assembled as a shelter placed on a frame of profile-bands leaving only the profile-band in the transverse direction visible, FIG. 35 illustrates a series of construction-units assembled as a shelter placed raised from a frame, FIG. 36 illustrates how the profile-band in transverse direction enfolds the profile-band going in the longitudinal direction, FIG. 37 illustrates an alternative version of the profile-band, FIG. 38 illustrates an alternative version of the profile-band, FIG. 39 illustrates how a series of construction-units are ended in the longitudinal direction, FIG. 40 illustrates how a series of construction-units are ended in the longitudinal direction by an end-piece that fits the shape of the construction-unit after being assembled, FIG. 41 illustrates how a series of construction-units are ended in the longitudinal direction, FIG. 42 illustrates how a series of construction-units are ended with an end-piece leaving a closed nut visible, FIG. 43 illustrates how a series of construction-units are ended with end-pieces can be added a wall going in the transverse direction at the end of the shelter, FIG. 44 illustrates how a series of construction-units are ended with end-pieces can be added a wall going in the transverse direction recessed from the end of the shelter, FIG. 45 illustrates the three wall-units separated to reveal how they are connected with a connection-unit that fits into horizontal holes in the wall-units, FIG. 46 illustrates how the three wall-units are connected to become an assembled wall-unit, FIG. 47 illustrates a wall-unit is placed on the profile-band placed in the transverse direction, FIG. 48 illustrates a top-connector which is a plate with two holes that secure the passage of the tension-bars, FIG. 49 illustrates a top-connector, which is a plate with two holes that secure the passage of the tension-bars, FIG. 50 illustrates a top-connector, which is a plate with two holes assembled with two conic tubes, FIG. 51 illustrates a top-connector, which is a plate with two holes assembled with two conic tubes, FIG. 52 illustrates a shelter covered with a tarpaulin stretched in the transverse direction and secured to the ground by placing a series of sandbags on the end flaps of the tarpaulin, FIG. 53 illustrates a shelter covered with a tarpaulin stretched in the transverse direction and a raised opening held up by poles and rope, FIG. 54 illustrates a shelter placed on a base and covered with a tarpaulin stretched in the transverse direction, FIG. 55 illustrates a shelter placed on an adjustable plinth and covered with a tarpaulin stretched in the transverse direction, FIG. 56 illustrates a shelter placed on a floor tarpaulin and covered with a tarpaulin stretched in the transverse direction, FIG. 57 illustrates three phases of transforming an immediate shelter into a more permanent structure, FIG. 58 illustrates how a series of immediate shelters are integrated in the roof-structure in two-story terraced houses.

DETAILED DESCRIPTION

FIG. 1 illustrates a three-dimensional view of the assembled construction 40 in a possible version consisting of sixteen construction-units 23 in order to indicate the longitudinal direction 1 and the transverse direction 2 of the assembled shelter-construction 40 placed as when in use. The construction-units 23 can make a construction in any desired length by adding more construction-units 23.

FIG. 2 illustrates a cross-section of a possible version of the invented construction-unit 23 in a vertical plane in the transverse direction 2 of the assembled construction. The cross-section reveals four following functional details:

First function revealed on FIG. 2 is the curved design that is similar to a hanging chain turned 180 degrees in a vertical plane. Mathematically this is a Hyperbolic Cosine. This Hyperbolic Cosine gives an ideal compression-arch in order to lead evenly distributed load to the supports with minimal or no bending moments.

Second function revealed on FIG. 2 is a groove 3 in the top of the construction-unit 23. This is meant for enfolding 11 a pole or a tube 10 placed in longitudinal direction 1 perpendicular to the cross-section. The enfolding 11 is possible when assembling the unit with a similar unit facing each other at the top. This is illustrated on FIG. 10 and FIG. 11.

Third function revealed on FIG. 2 is one or more horizontal holes 4 meant to tighten multiple construction-units 23 together in the longitudinal direction 1 by leading a steel-bar 17 through and fastened with thread, washer 19 and nut 18. This is illustrated on FIG. 16 and FIG. 17.

Fourth function revealed on FIG. 2 is the groove 5 at the bottom of the construction-unit suitable for fitting onto a tongue on top of the plinth or foundation.

FIG. 3 illustrates a cross-section in an arbitrary plane in the longitudinal direction 1 perpendicular to a tangent of the curve of a construction-unit 23. FIG. 3 reveals the tongue 6 and groove 7 that could be one of more possible ways to assemble the construction-units 23 continuously in the longitudinal direction 1 until the desired length is obtained. An alternative assembling method is illustrated on FIG. 12 and FIG. 13.

FIG. 4 illustrates a three-dimensional view of a construction-unit 23 placed as in use from a chosen viewpoint where the position of the construction-unit 23.

FIG. 5 illustrates a three-dimensional view of a construction-unit 23 placed as in use from a chosen viewpoint where the position of the construction-unit 23 is turned 90 degrees in a horizontal plane compared to the similar construction-unit 23 illustrated on FIG. 4.

FIG. 6 illustrates a three-dimensional view of a construction-unit 23 placed as in use from a chosen viewpoint where the position of the construction-unit 23 is turned 180 degrees in a horizontal plane compared to the similar construction-unit 23 illustrated on FIG. 4.

FIG. 7 illustrates a three-dimensional view of a construction-unit 23 placed as in use from a chosen viewpoint where the position of the construction-unit is turned 270 degrees in a horizontal plane compared to the similar construction-unit 23 illustrated on FIG. 4.

FIG. 8 illustrates a three-dimensional view of two similar construction-units 23 being put together in the longitudinal direction 1 while the arrows indicate the movement 8 of the construction-units 23 in order to assemble them in the longitudinal direction 1.

FIG. 9 illustrates a three-dimensional view of two similar construction-units 23 that have been joined 9 in order to assemble them in the longitudinal direction 1.

FIG. 10 illustrates a three-dimensional view of two similar construction-units 23 being put together in the transverse direction 2 while the arrows indicate the movement of the construction-units in order to assemble them in order to make shelter in a vertical plane in the transverse direction 2 by enclosing around a pole or a pipe 10 in the top with the groove 3 in the top of each of the two similar construction-units 23.

FIG. 11 illustrates a three-dimensional view of two similar construction-units 23 put together 11 in the transverse direction 2 in order to make shelter in a transverse plane by enclosing around a pole or a pipe 10 in the top with the groove 3 in the top of each of the two similar construction-units 23.

FIG. 12 illustrates a three-dimensional view of a construction-unit 23 that reveals the one of two parts of an assembling-method as an alternative to the "Tongue and Groove"-principle where the revealed detail shows a circular conic dent 12 in the side of the unit that is a possible substitute for a groove in relation to the "Tongue and Groove"-principle.

FIG. 13 illustrates a three-dimensional view of a construction-unit 23 that reveals the second of two parts of an assembling-method as an alternative to the "Tongue and Groove"-principle where the revealed detail shows a circular conic assembling-tongue 13 in the side of the unit that is a possible substitute for a groove or dent 12 in relation to the "Tongue and Groove"-principle.

FIG. 14 illustrates a three-dimensional view of two units that can be connected to each other by an assembling method for assembling the construction-units 23 in the longitudinal direction 1 based on a separate circular double-conic assembling-unit 14. The assembling-unit 14 will transfer loads from one constriction-unit 23 to another in a vertical plane in the transverse direction 2. When placed correctly the assembling-unit 14 may have a hole 24 in the middle in the longitudinal direction 1 giving the opportunity to put a tension-bar 17 through it. The assembling-unit 14 could comprise a groove 25 or a hole in order to help keeping the construction-units 23 together in the transverse direction 2. This requires tension strings or bars 16 attached to the assembling-units 14 as illustrated on FIG. 15. The assembling unit 14 should fit into a version of the construction-unit 23 with multiple circular conic dents 15 on both sides as an alternative to tongue 6 and groove 7.

FIG. 15 illustrates a three-dimensional view of multiple construction-units 23 connected by the assembling method from FIG. 14, which offers the opportunity to keep the assembling-units 23 connected in the transverse direction 2 by adding tension strings, wire or bars 16. The strings, wire or bars 16 are supposed to fit into a groove 25 or a hole in assembling-units 14. This makes it possible to connect and keep together the two sides of the construction around the pole 10 in the top of the construction.

FIG. 16 illustrates a three-dimensional view of how multiple construction-units 23 can be tightened together in the longitudinal direction 1 by putting tension-bars 17 through the holes 4 precast in the construction-units 23. The tension-bars 17 are supposed to be put through the construction units 23 and through the centre of the assembling-units 14.

FIG. 17 illustrates a three-dimensional view of how a plurality of construction-units 23 can be tightened together in the longitudinal direction 1 by finishing the tension-bars 17 from FIG. 16 by cutting a thread and adding a washer 19 and a nut 18. For a permanent construction the dents 15 could be plastered with cement and for a transitional construction the assembling could be covered with tarpaulins and fixed with sandbags.

FIG. 18 illustrates a cutout part the of top of the cross-section shown on FIG. 1 that reveals a possible solution of composite layers of the construction-unit 23 where the main constituent 22 and core is cement-based material-composition like polystyrene concrete or aerated concrete. The next layer on both sides is a cement plaster 21 that is possibly closed with a waterproof 20 coating, plastering or casting on the outside. Surfaces are possibly added in a prefabrication process or possibly added when the units has been assembled to make the whole shelter. Reinforcement of possibly steel wire or net is added according to static recommendations.

FIG. 19 illustrates a cutout part the of top of the cross-section shown on FIG. 1 that reveals a possible solution of composite layers of the construction-unit 23 where the main constituent 28 and core material is Expanded Polystyrene (EPS). The next layer on both sides is a cement-based plaster 26 that enfolds a reinforcement net of glass fibres. Surfaces are possibly added in a prefabrication process or possibly added when the units has been assembled to make the whole shelter 40. Reinforcement of possibly made with steel wire or steel net, added according to static recommendations. Edges are protected by a band 27 that is glued to the edges of the construction-unit 23 before coating it. This band 27 is made of extruded plastic and has 3 basic functions. First function is protection of edges.

Second function is defining thickness of the coating. Third function is being a weather strip that holds back water and draught when the construction-units 23 are connected and tightened together.

FIG. 20 illustrates a band 32 that is able to makes a hidden fixed connection between the construction-units 23 and a wall 33 put up in the transverse direction 2 of the shelter. The band can be made of steel, metal or polymer. The band 32 can fix the wall 33 in both back and forth in the longitudinal direction 1 of the shelter with two rows of flaps 29+30 that are bended 90 degrees in proportion to the plate they are made from. The band 32 has a row of flaps 31 that are bend 180 degrees in proportion to the other flaps 29+30. The parallel flaps 29+30 can fit into grooves 34 made in the wall units 33.

FIG. 21 illustrates a band 32 that is connected into the grooves 34 of a wall 33 put up in the transverse direction 2 of the shelter. Only one row of flaps 31 are now exposed. Thereby it is able to be hidden in a fixed connection between the construction-units 23 and a the wall 33.

FIG. 22 illustrates how tour basic parts makes it possible to make a hidden fixed connection between the wall 33 and the construction-units 23 seen from outside of the shelter. The band 32 is connected into the wall 33 put up in the transverse direction 2 of the shelter. By connecting the construction-units 23 it is now able to make a hidden and fixed connection between the construction-units 23 and the wall 33.

FIG. 23 illustrates how it is possible to make a hidden fixed connection between the wall 33 and the construction-units 23 seen from inside of the shelter before assembled. The band 32 is connected into the wall 33 put up in the transverse direction 2 of the shelter. By connecting the construction-units 23 it is now able to make a hidden and fixed connection between the construction-units 23 and the wall 33.

FIG. 24 illustrates how it is possible to make a hidden fixed connection between the wall 33 and the construction-units 23 seen from inside of the shelter after assembled. The band 32 from FIG. 23 is no longer visible.

Figure 1:
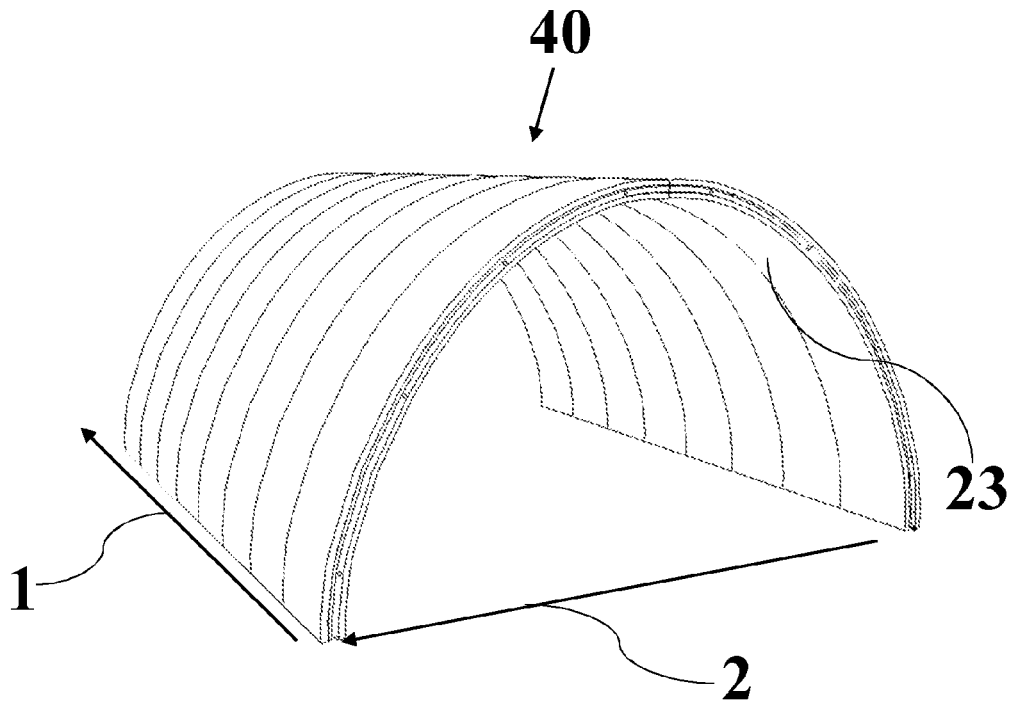
Figure 2:
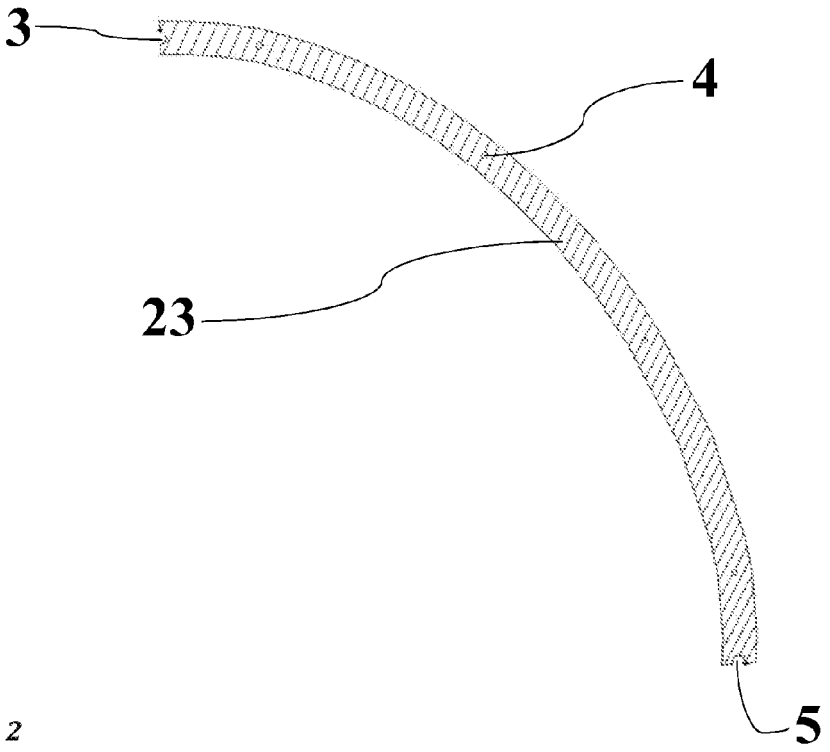
Figure 3:
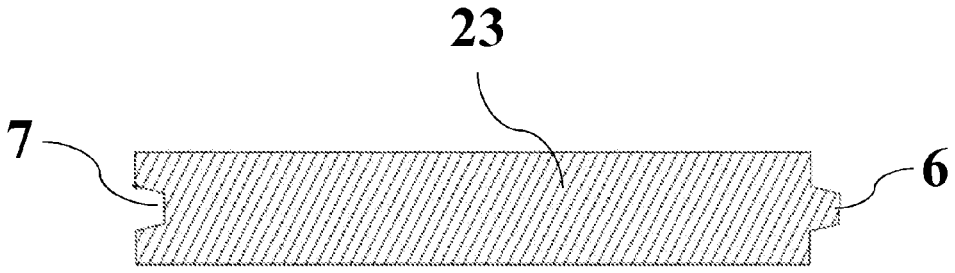
Figure 4:
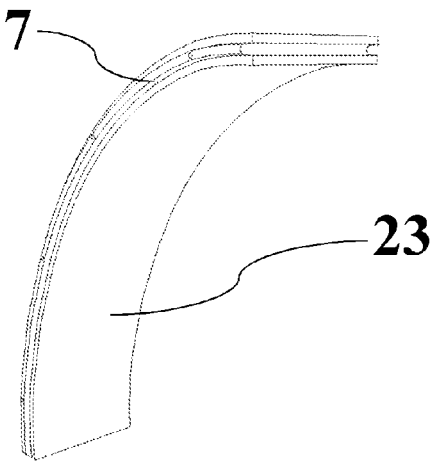
Figure 5:
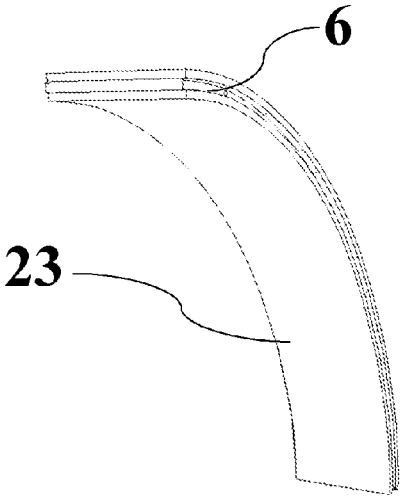
Figure 6:
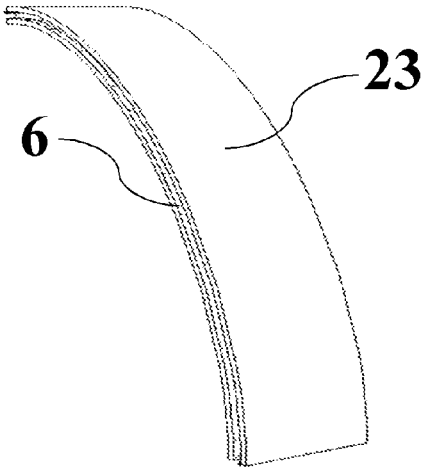
Figure 7:
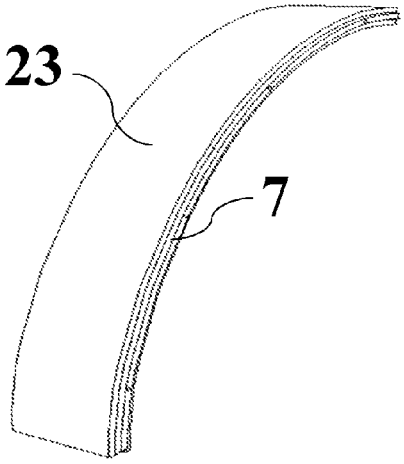
Figure 8:
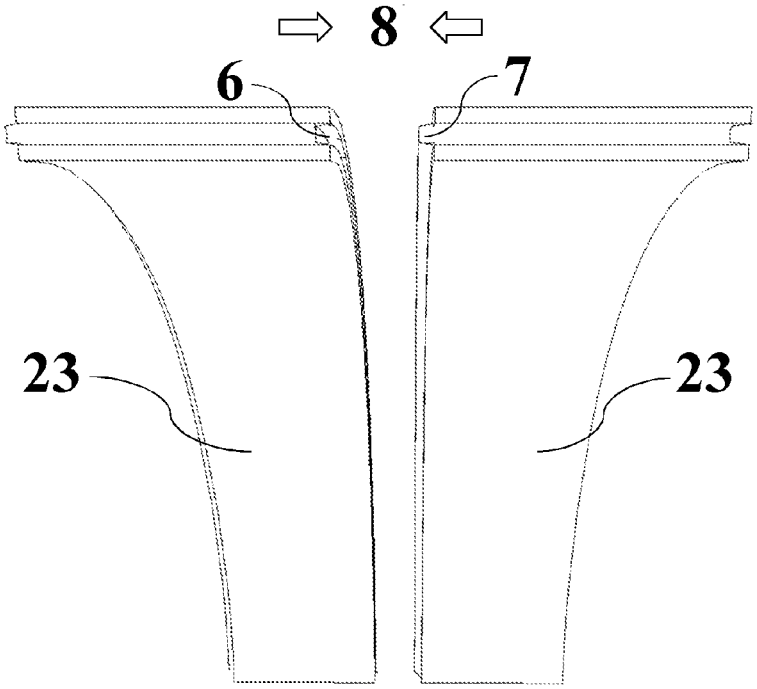
Figure 9:
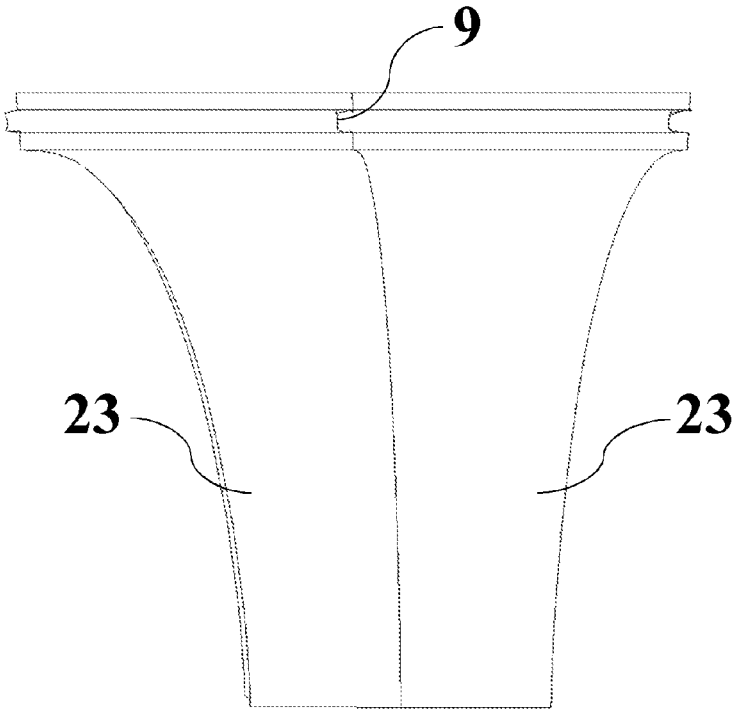
Figure 10:
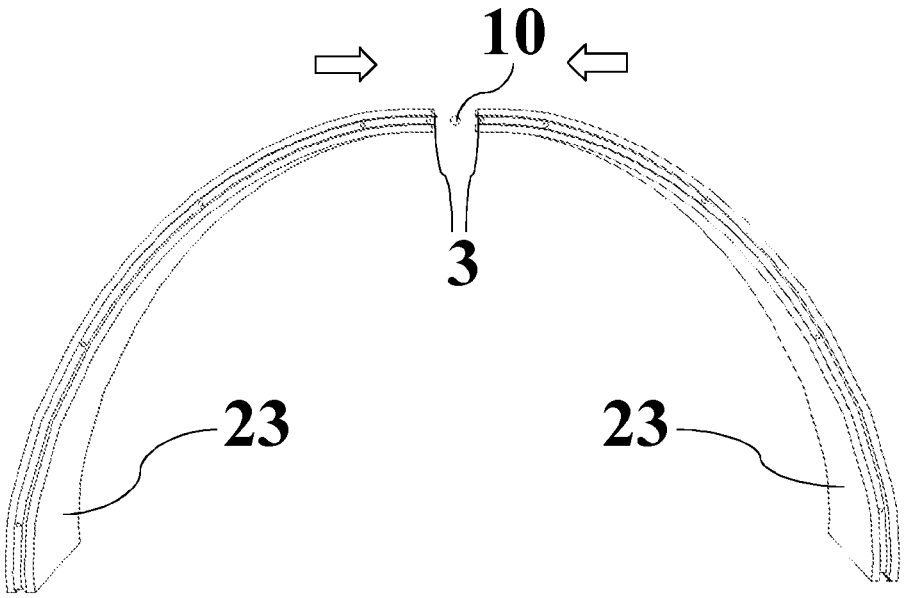
Figure 11:
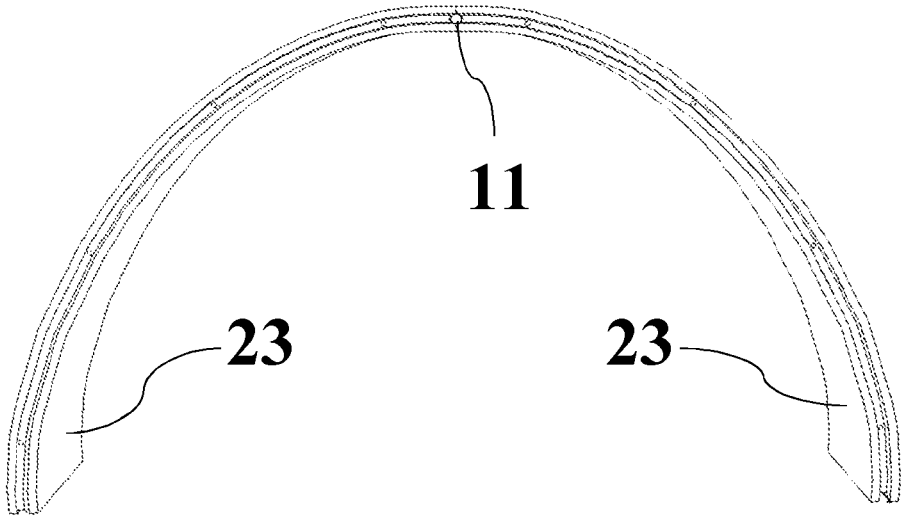
Figure 12:
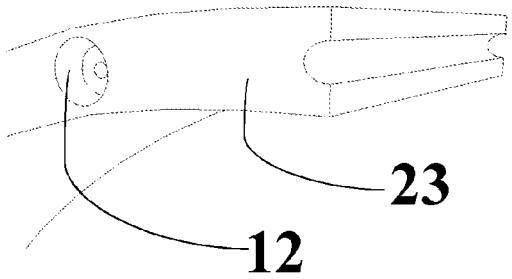
Figure 13:
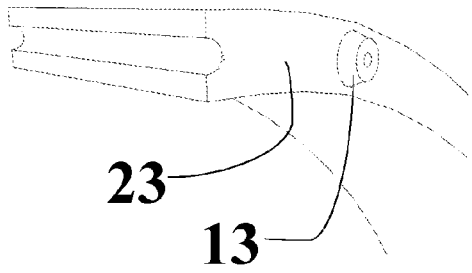
Figure 14:
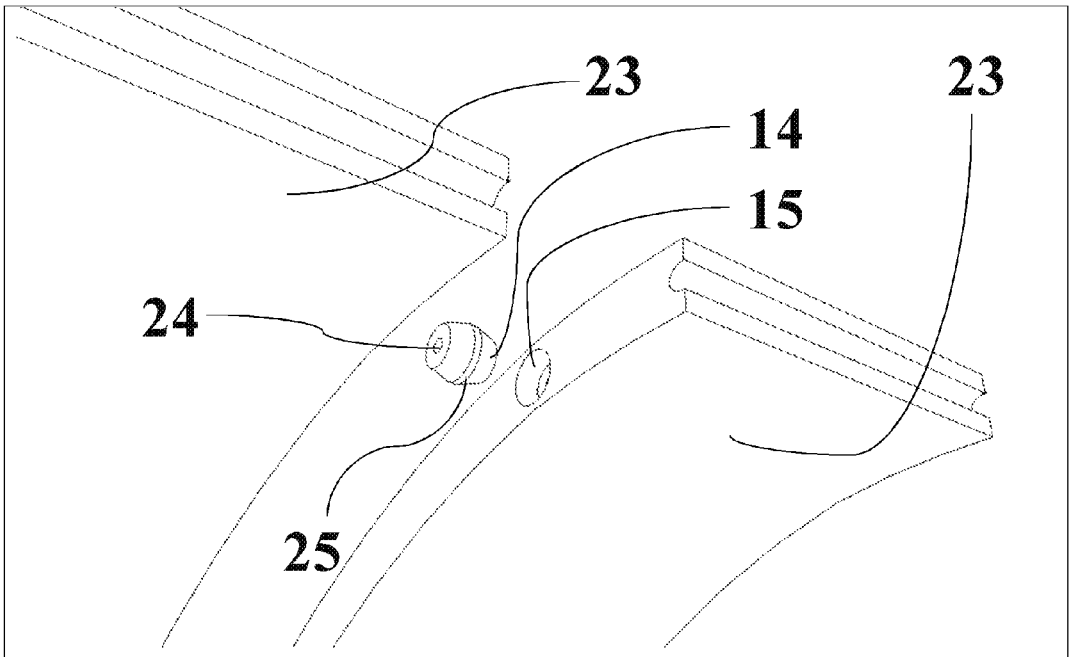
Figure 15:
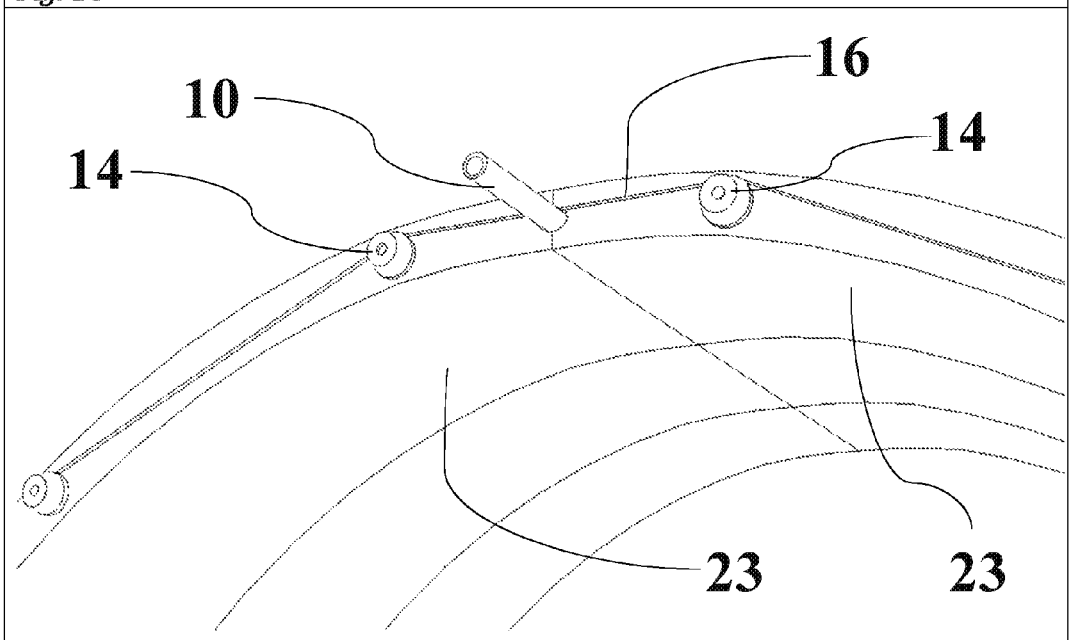
Figure 16:
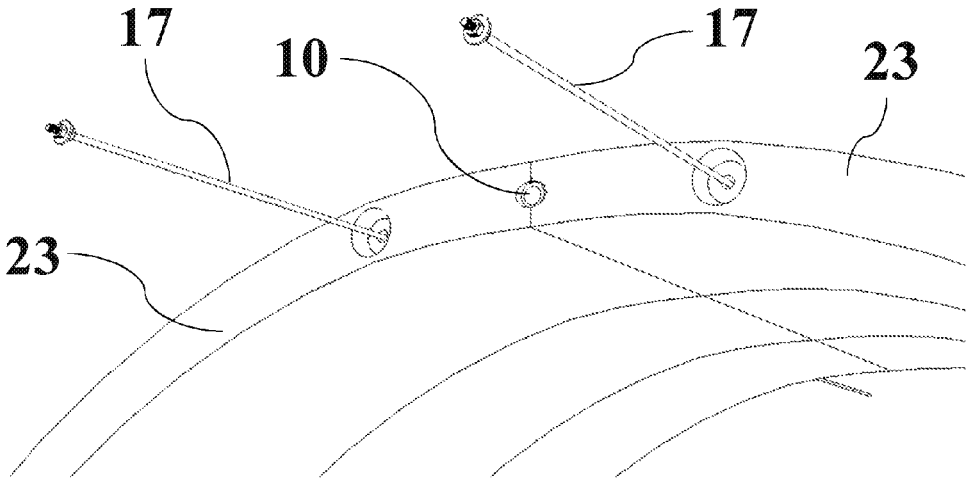
Figure 17:
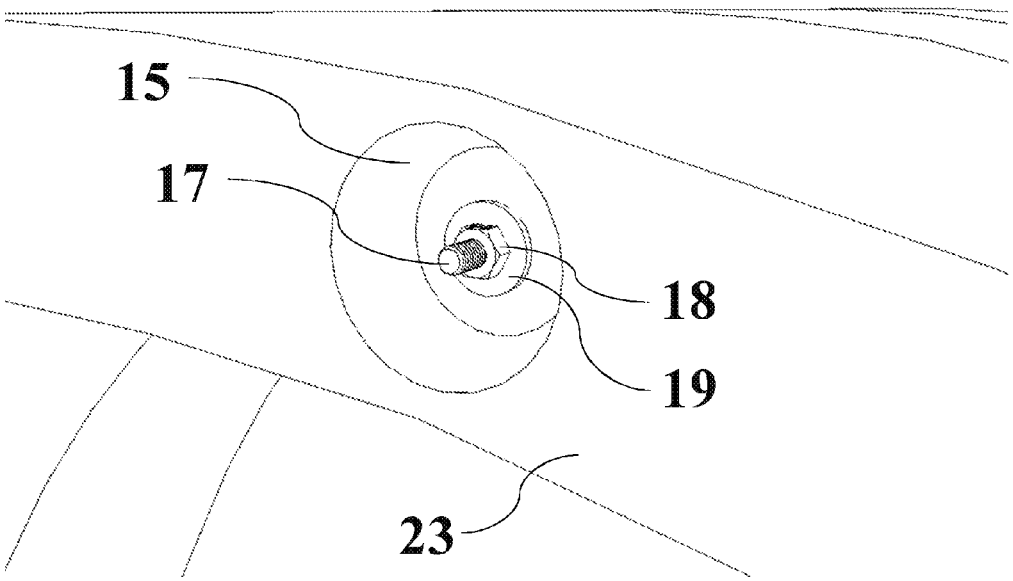
Figure 18:
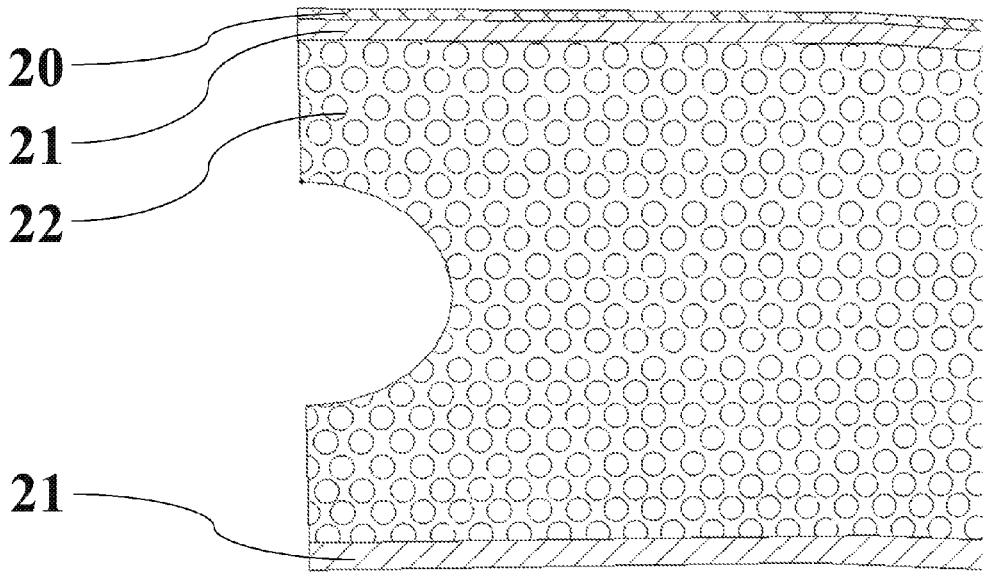
Figure 19:
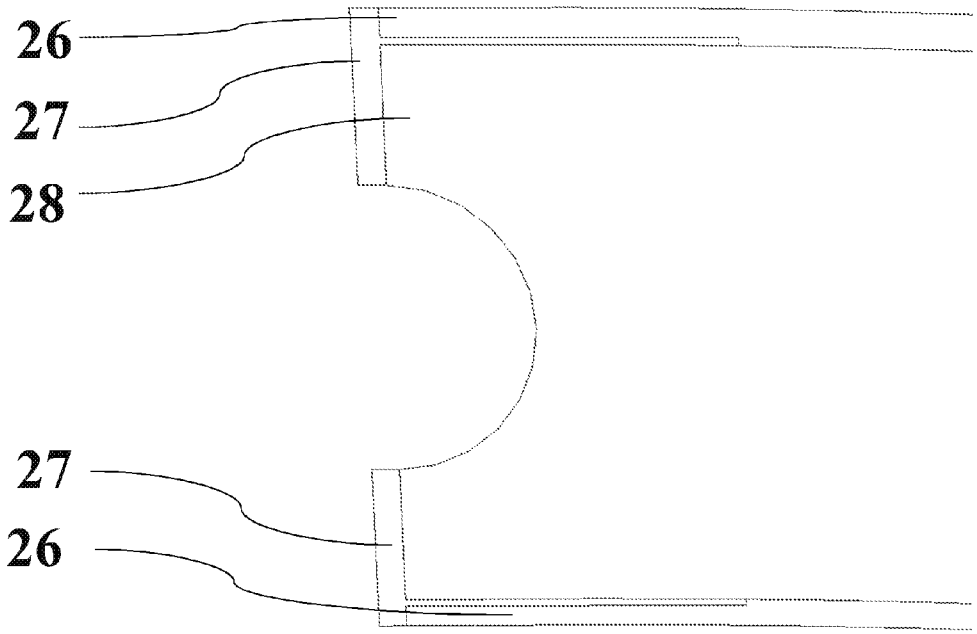
Figure 20:
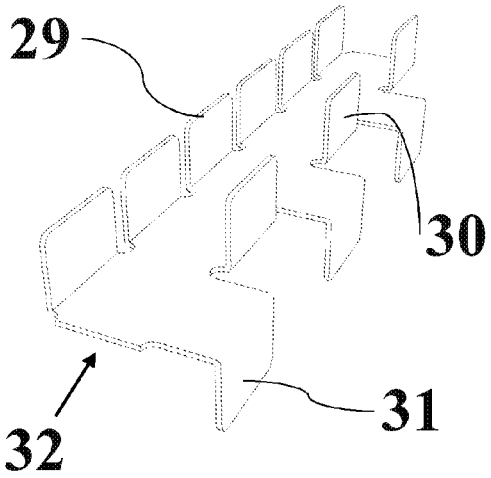
Figure 21:
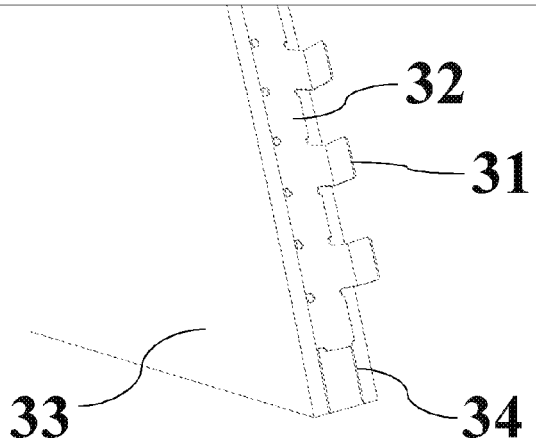
Figure 22:
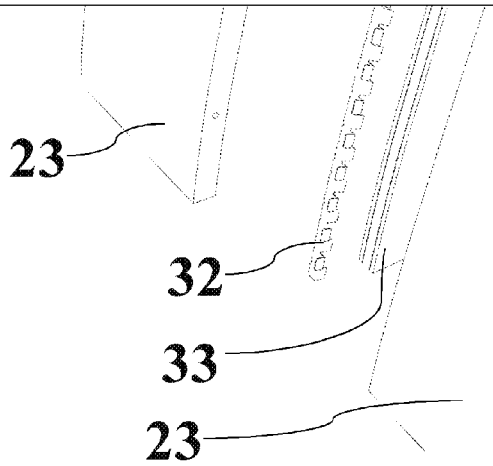
Figure 23:
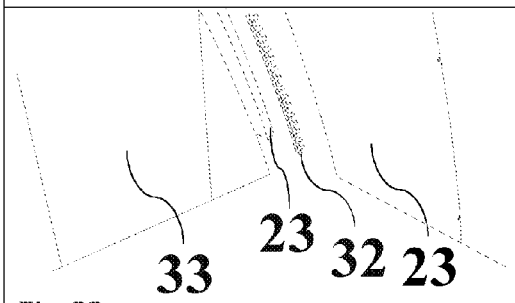
Figure 24:
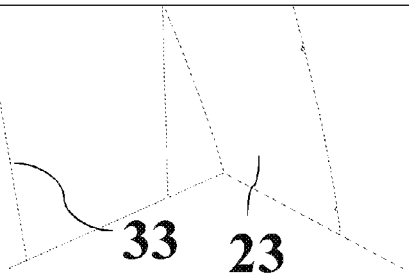
Figure 25:
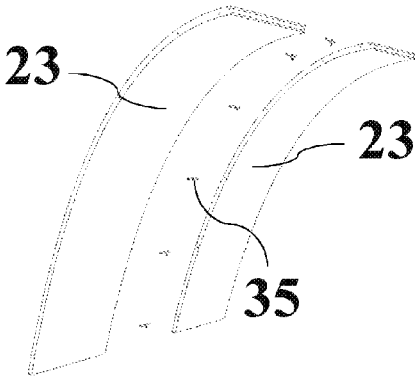
FIG. 25 illustrates a three-dimensional view of two similar construction-units 23 being able to join in the longitudinal direction by enclosing a series of assembling units 35.
Figure 26:
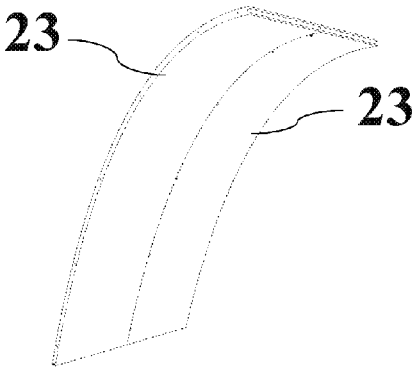
FIG. 26 illustrates a three-dimensional view of two similar construction-units 23 joined in the longitudinal direction by enclosing a series of assembling units 35.
Figure 27:
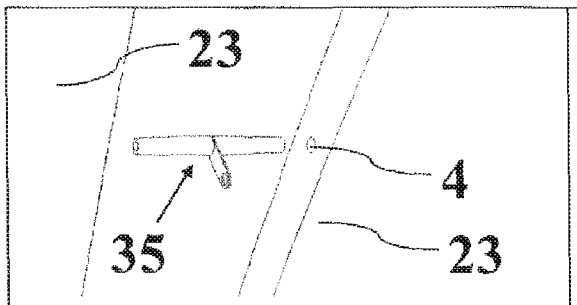

FIG. 27 illustrates a three-dimensional view of two similar construction-units 23 being able to join in the longitudinal direction by enclosing an assembling unit 35 by making it fit into the holes 4 in the construction-units. The view reveals the assembling unit 35 before joining the construction-units 23 in the longitudinal direction 1.

Figure 28:
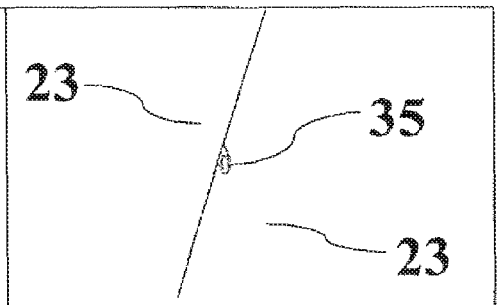

FIG. 28 illustrates a three-dimensional view of two similar construction-units 23 joined in the longitudinal direction by enclosing an assembling unit 35 leaving only a part of the assembling-unit visible. The view reveals the part of the assembling unit 35 that makes it possible to hang something up after joining the two similar construction-units 23 in the longitudinal direction 1.

Figure 29:
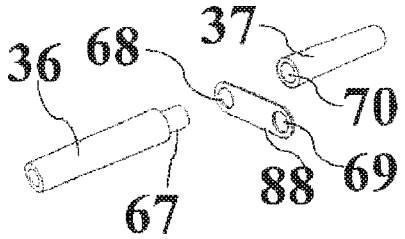

FIG. 29 illustrates a three-dimensional view of the three separate parts that becomes an assembling unit 35 when joined. The first part that is included in the assembling unit 35 is a conic tube 36 that has an end 67 with a smaller diameter. The second part that is included in the assembling unit 35 is a conic tube 37 that has a dent 70 in one end that fits the end 67 of the other conic tube 36. The third part 88 has a hole 68 that fits around the end 67 of the other conic tube 36. Hole 69 makes it possible to hang something up inside the shelter after joining the two similar construction-units 23 in the longitudinal direction 1.

Figure 30:
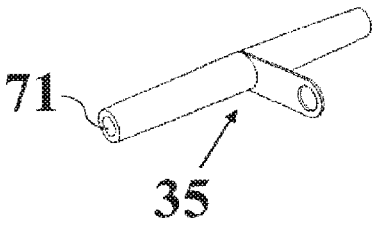

FIG. 30 illustrates a three-dimensional view of the three separate parts that has been joined to become an assembling unit 35. The hole 71 makes it possible to lead a tension bar 17 through the holes 4 of two construction-units 23 joined in the longitudinal direction 1. The assembling unit 35 can be made of wood, steel, metal or polymer.

Figure 31:
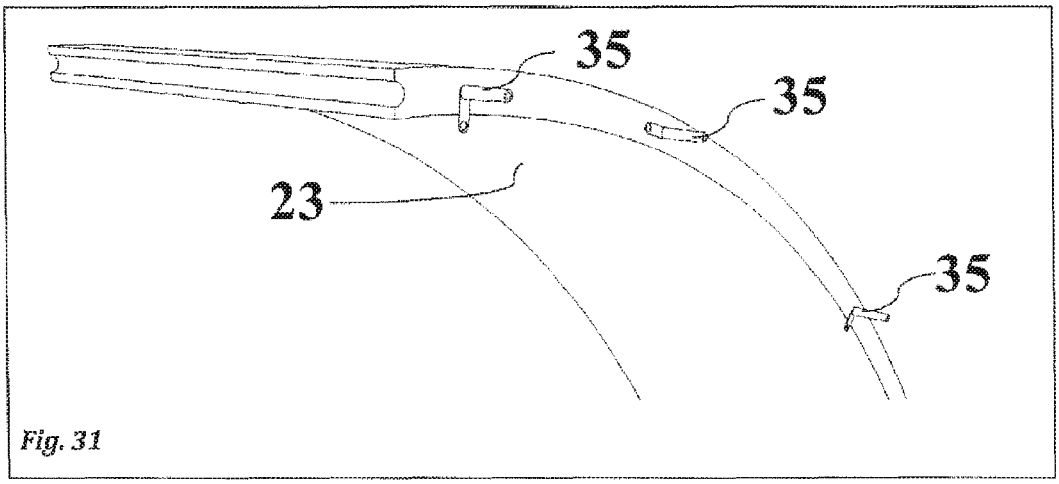

FIG. 31 illustrates a three-dimensional view of a series of assembling-units 35 attached to a construction-unit 23 its holes 4 going in the longitudinal direction 1. The assembling-unit can be twisted in order to make the flat part of the assembling-unit 35 visible or hidden.

Figure 32:
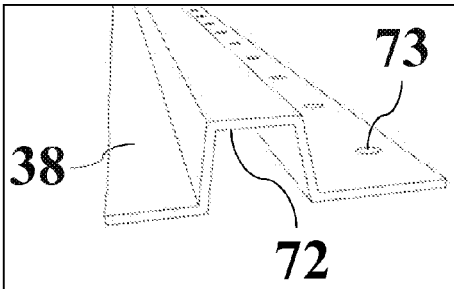

FIG. 32 illustrates a profile-band 38 with a raised mid-section 72 that can be used for fixing the construction-unit 23 in the horizontal transverse direction 2 of the shelter 40. The band also has a row of holes 73 for fixing it to the ground, a plinth, a base or a wall. The band can be made of steel, metal or polymer.

Figure 33:
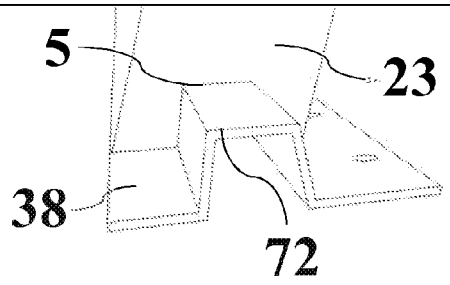

FIG. 33 illustrates an assembling of a profile-band 38 and a construction-unit 23. The profile-band 38 has a raised mid-section 72 that fits into a groove in the lowest part of the construction-unit. This makes it able to fixing the construction-unit 23 in the horizontal transverse direction 2 by securing it to the ground, a plinth, a base or a wall.

Figure 34:
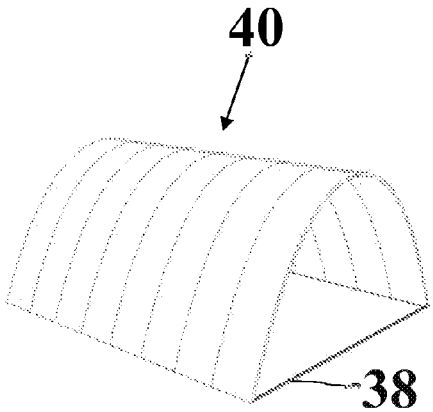

FIG. 34 illustrates a series of construction-units 23 assembled as a shelter 40 placed on a frame of profile-bands leaving only the profile-band 39 in the transverse direction 2 visible.

Figure 35:
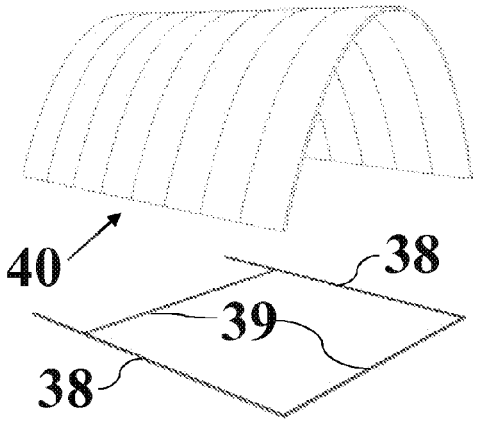

FIG. 35 illustrates a series of construction-units 23 assembled as a shelter 40 placed raised from a frame of two parallel profile-bands 39 placed in the transverse direction 2 and two parallel profile-bands 38 placed in the longitudinal direction 1.

Figure 36:
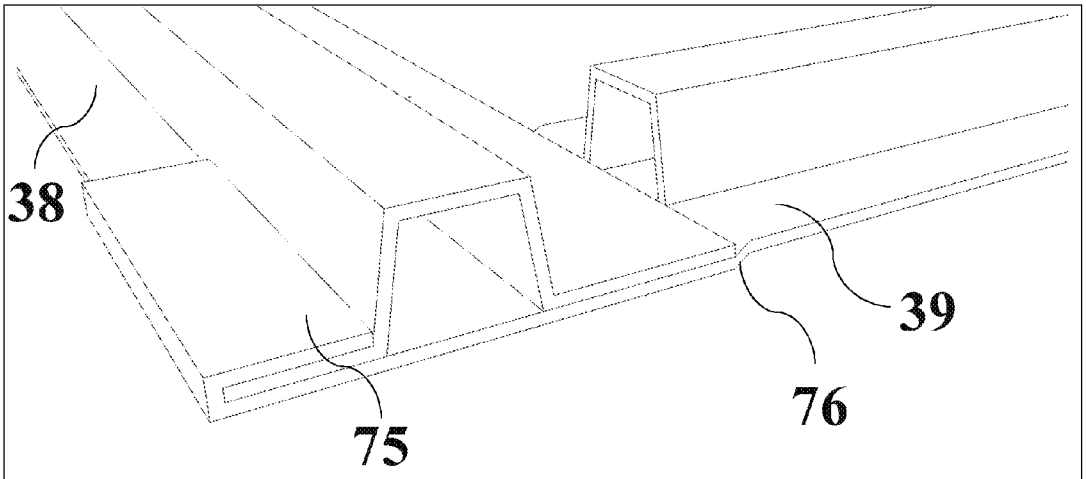

FIG. 36 illustrates how the profile-band 39 in transverse direction 2 enfolds 75 the profile-band 38 going in the longitudinal direction 1 by letting the lower part of the profile-band 39 continue with a smaller displacement 76 under the profile-band 38 in the longitudinal direction and enfolding 75 it.

Figure 37:
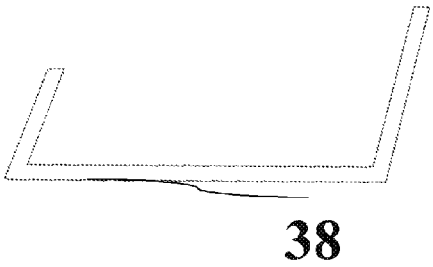

FIG. 37 illustrates an alternative version of the profile-band 38.

Figure 38:
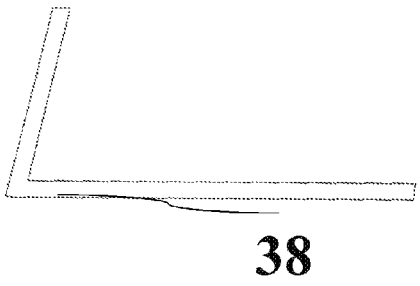

FIG. 38 illustrates an alternative version of the profile-band 38.

Figure 39:
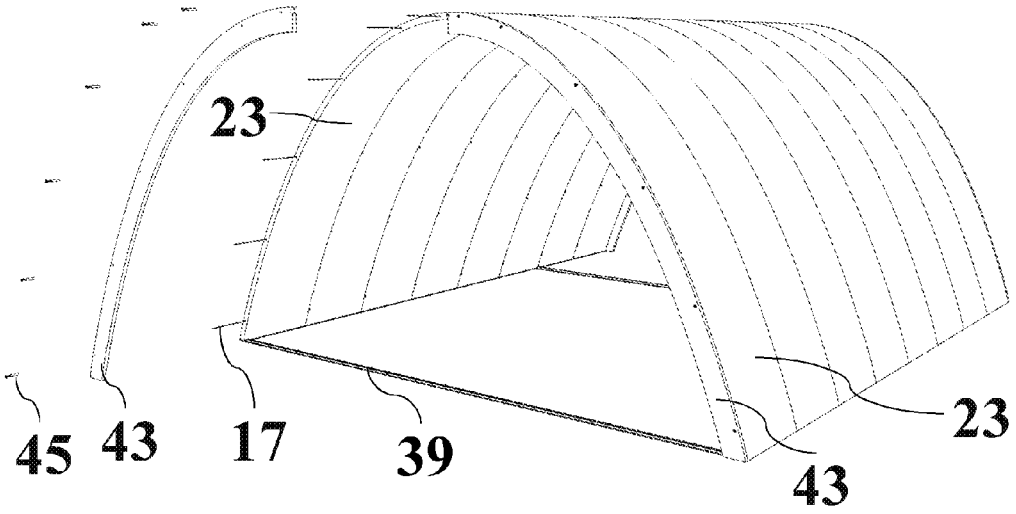

FIG. 39 illustrates how a series of construction-units 23 are ended in the longitudinal direction 1 by an end-piece 43 that fits the shape of the construction-unit 23 and secures the passage of the tension-bars 17 so the can be ended with a nut 45 just before being fully assembled.

Figure 40:
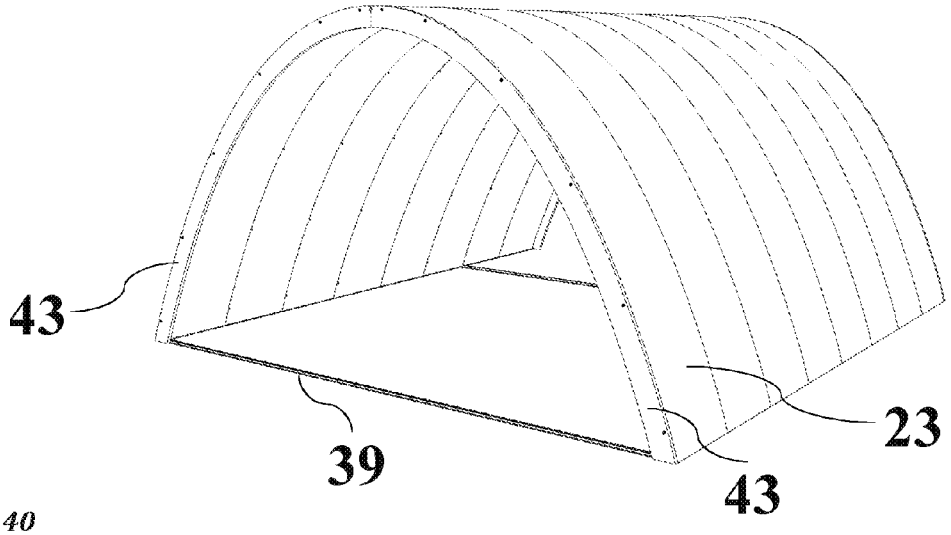

FIG. 40 illustrates how a series of construction-units 23 are ended in the longitudinal direction 1 by an end-piece 43 that fits the shape of the construction-unit 23 after being assembled.

Figure 41:
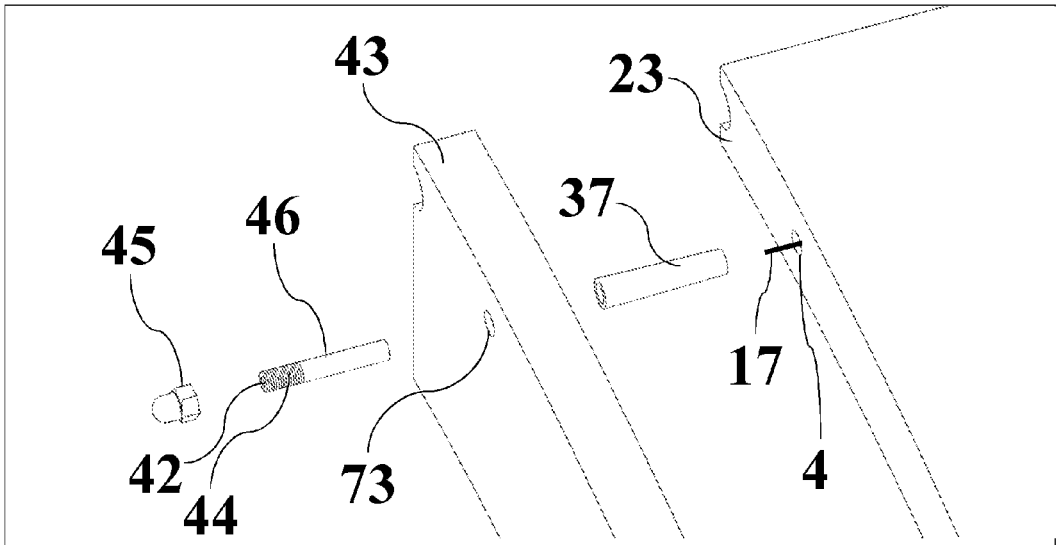

FIG. 41 illustrates how a series of construction-units 23 are ended in the longitudinal direction 1 by leading a tension-bar 17 through a conic tube 37 and fit into an inner thread 42 in a connection-unit 46 going through a hole 73 in an end-piece 43 leaving a outer thread 44 visible to be ended with a closed nut 45.

Figure 42:
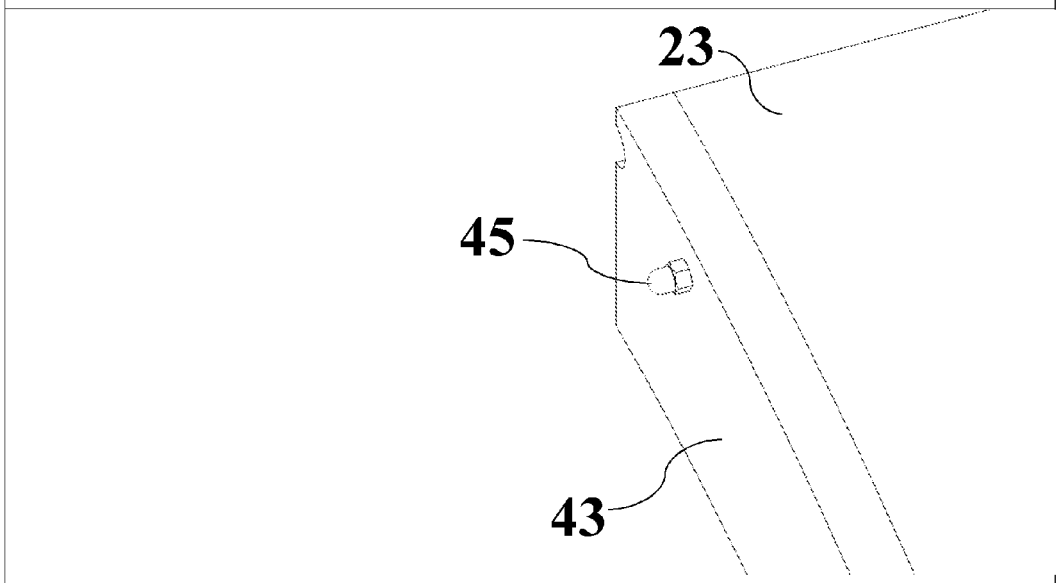

FIG. 42 illustrates how a series of construction-units 23 are ended with an end-piece 43 leaving a closed nut 45 visible.

Figure 43:
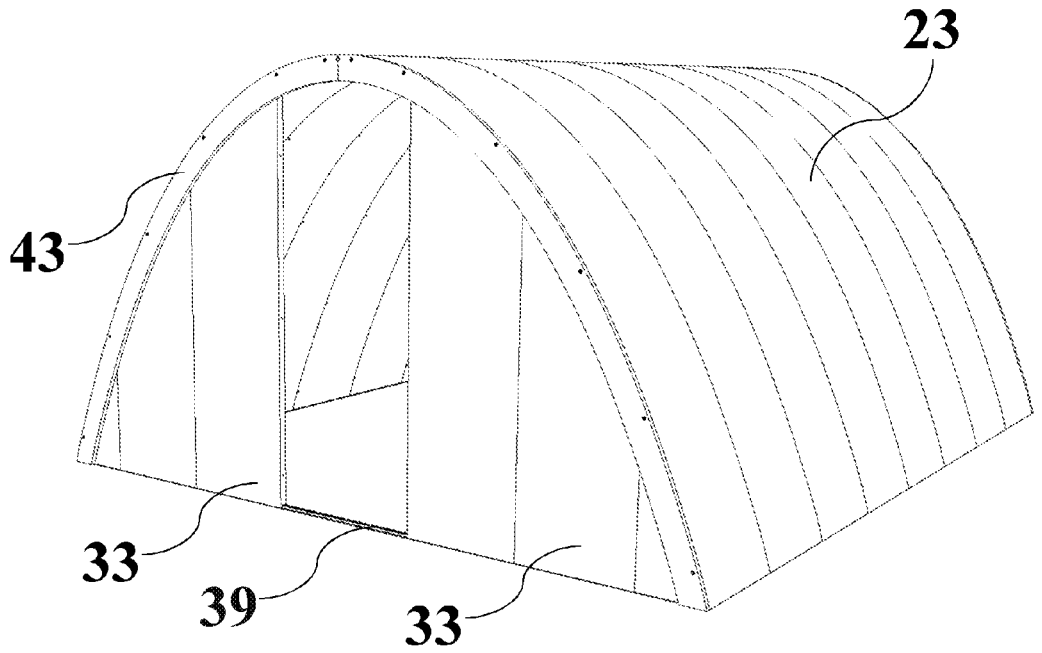

FIG. 43 illustrates how a series of construction-units 23 are ended with end-pieces 43 can be added a wall 33 going in the transverse direction 2 at the end of the shelter 40.

Figure 44:
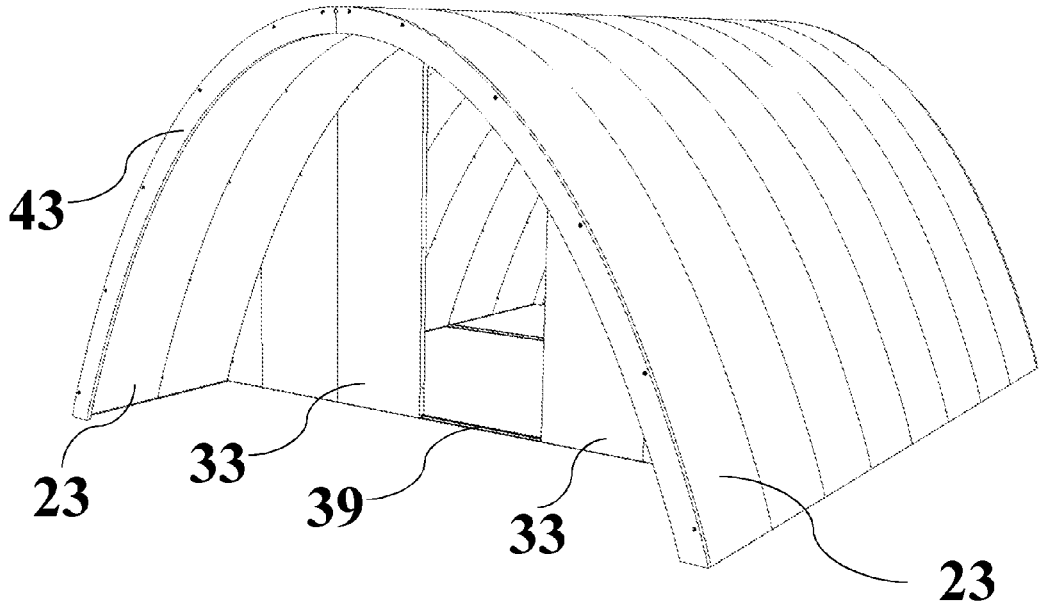

FIG. 44 illustrates how a series of construction-units 23 are ended with end-pieces 43 can be added a wall 33 going in the transverse direction 2 recessed from the end of the shelter 40.

Figure 45:
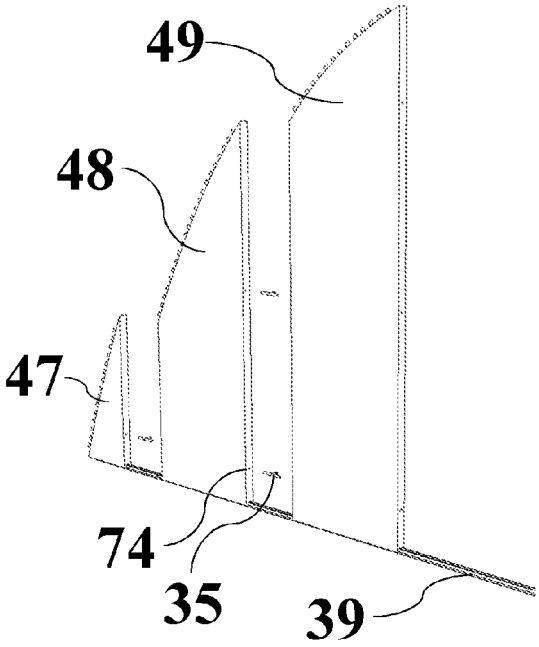

FIG. 45 illustrates the three wall-units 47+48+49 separated to reveal how they are connected with a connection-unit 35 that fits into horizontal holes 74 in the wall-units 47+48+49.

Figure 46:
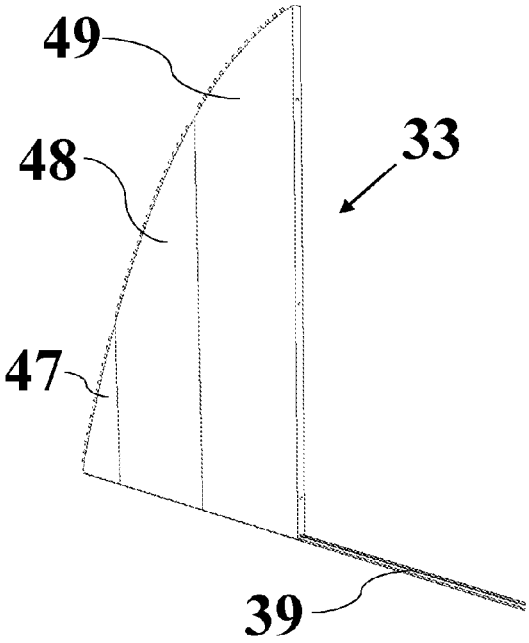

FIG. 46 illustrates how the three wall-units 47+48+49 are connected to become an assembled wall-unit 33.

Figure 47:
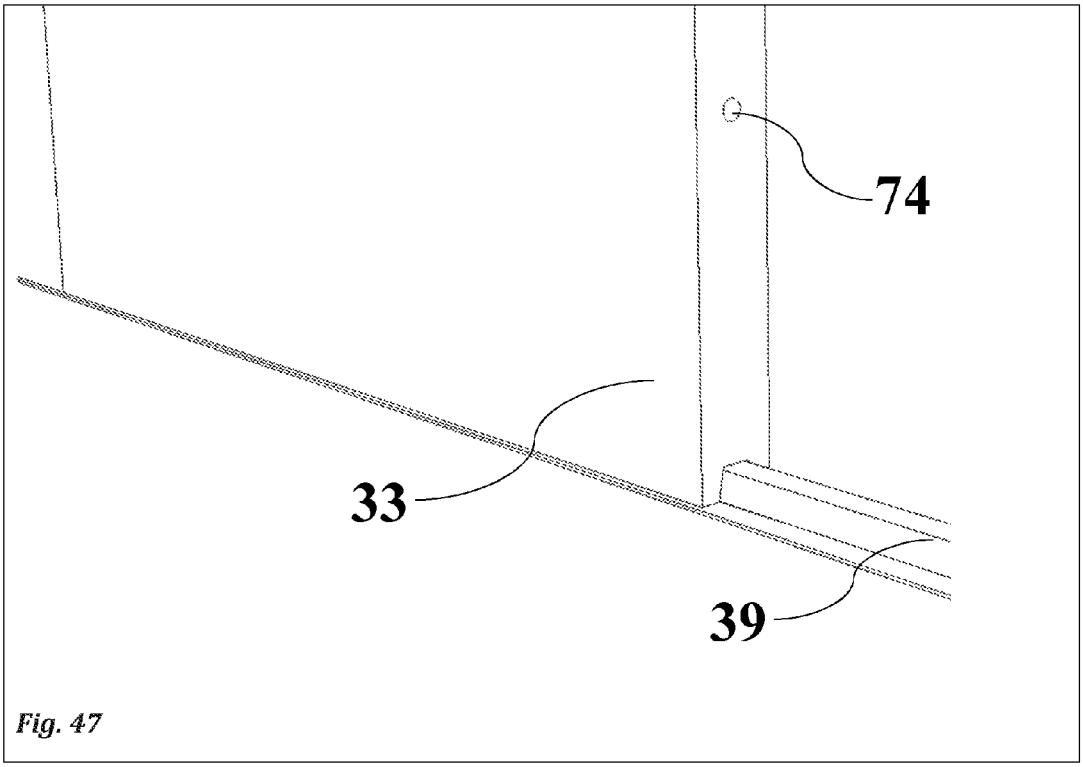

FIG. 47 illustrates a wall-unit 33 is placed on the profile-band 39 placed in the transverse direction 2.

Figure 48:
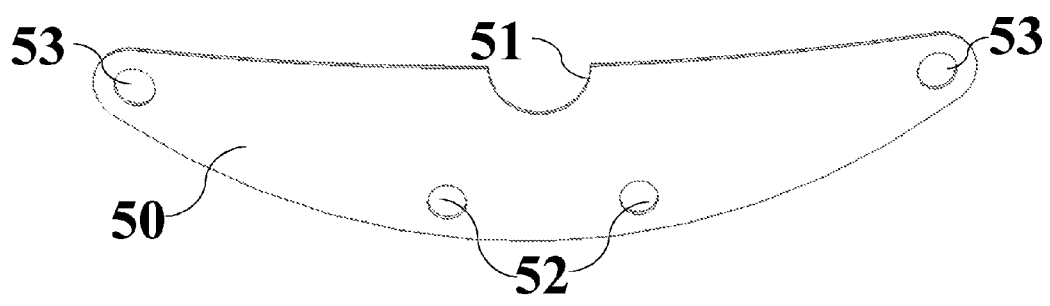

FIG. 48 illustrates a top-connector 50 which is a plate with two holes that secure the passage of the tension-bars 17. The top-connector 50 has an upper middle area 51 that can fit around the lower half of the top tube 10. The top-connector also has two holes 52 for hanging something up inside the shelter 40 when assembled. The top-connector can consist of metal, polymer or steel.

Figure 49:
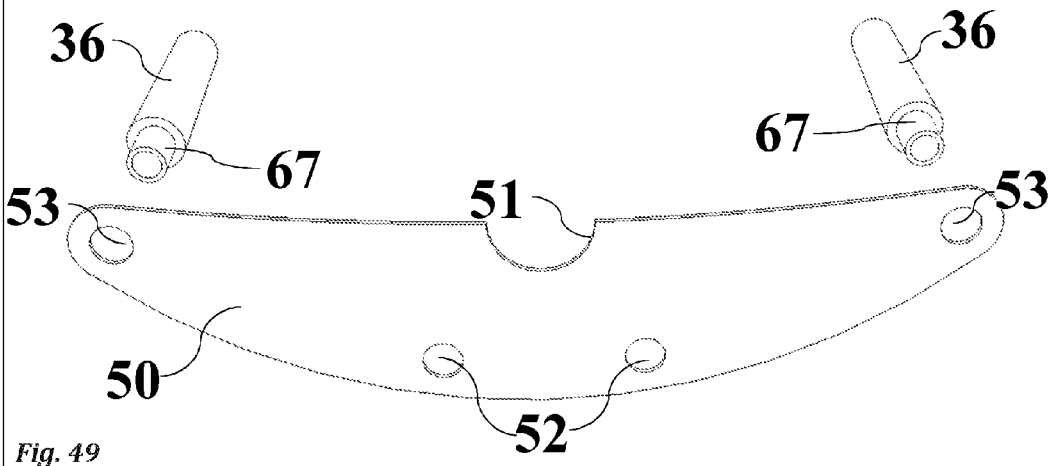

FIG. 49 illustrates a top-connector 50, which is a plate with two holes 53 that secure the passage of the tension-bars 17 by leaving holes 53 the fit the conic tube 36 that can be placed in the upper hole of the two similar construction-units 23 facing each other in the top on each side of the top tube 10.

Figure 50:
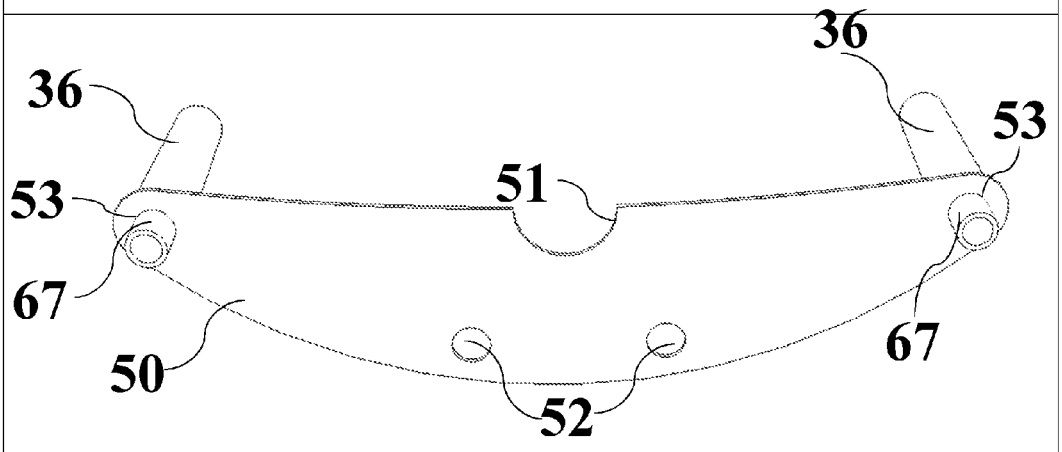

FIG. 50 illustrates a top-connector 50, which is a plate with two holes 53 assembled with two conic tubes 36 that can be placed in the upper hole of the two similar construction-units 23 facing each other in the top on each side of the top tube 10

Figure 51:
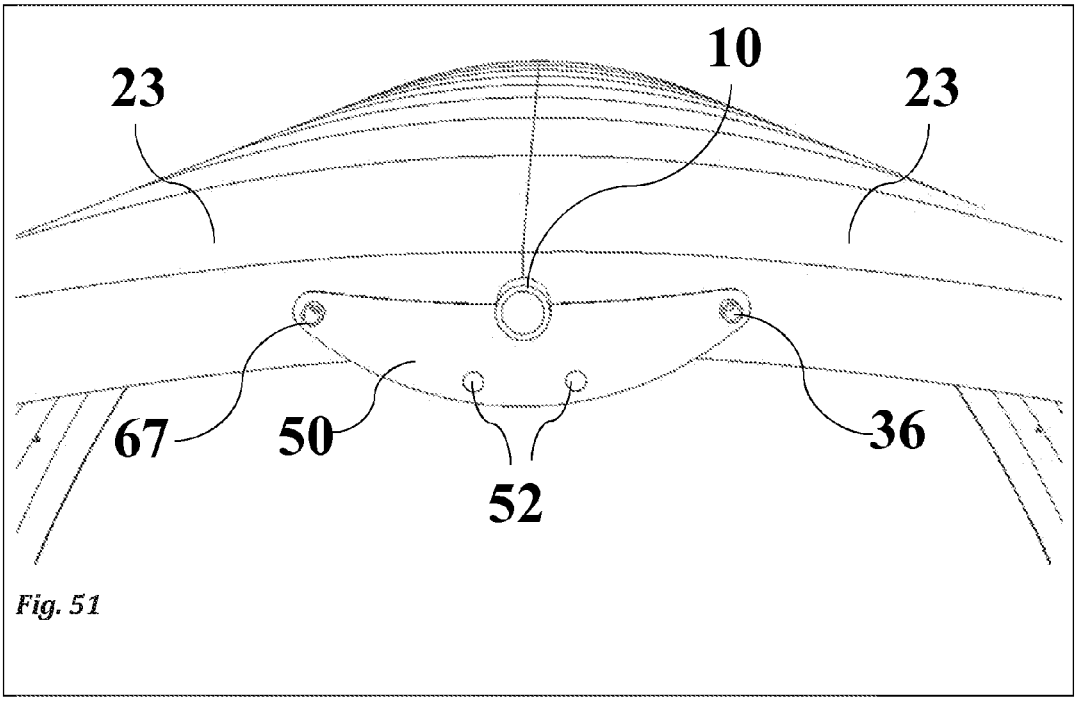

FIG. 51 illustrates a top-connector 50, which is a plate with two holes 53 assembled with two conic tubes 36 that are placed in the upper hole of the two similar construction-units 23 facing each other in the top on each side of the top tube 10

Figure 52:
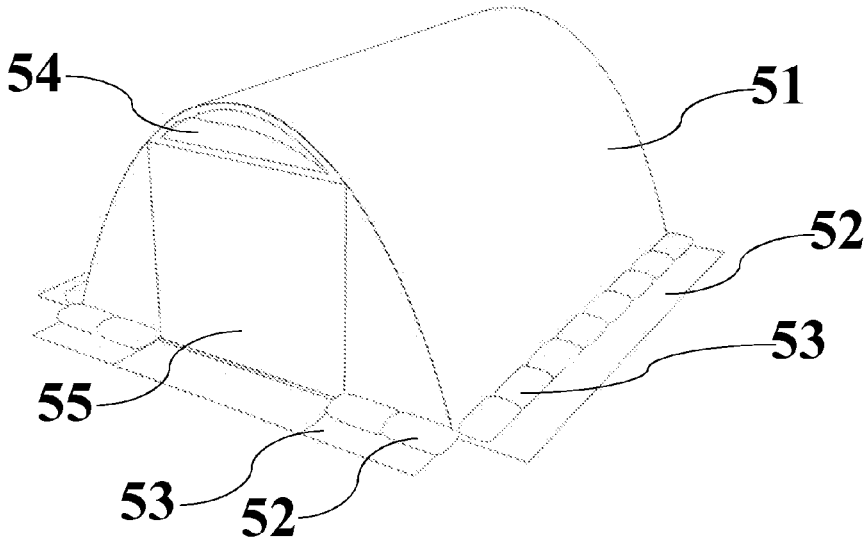

FIG. 52 illustrates a shelter 40 covered with a tarpaulin 51 stretched in the transverse direction 2 and secured to the ground by placing a series of sandbags 53 on the end flaps 52 of the tarpaulin 51. The end has an opening 55 and a ventilated top 54. The tarpaulin can be made from polymer or treated canvas.

Figure 53:
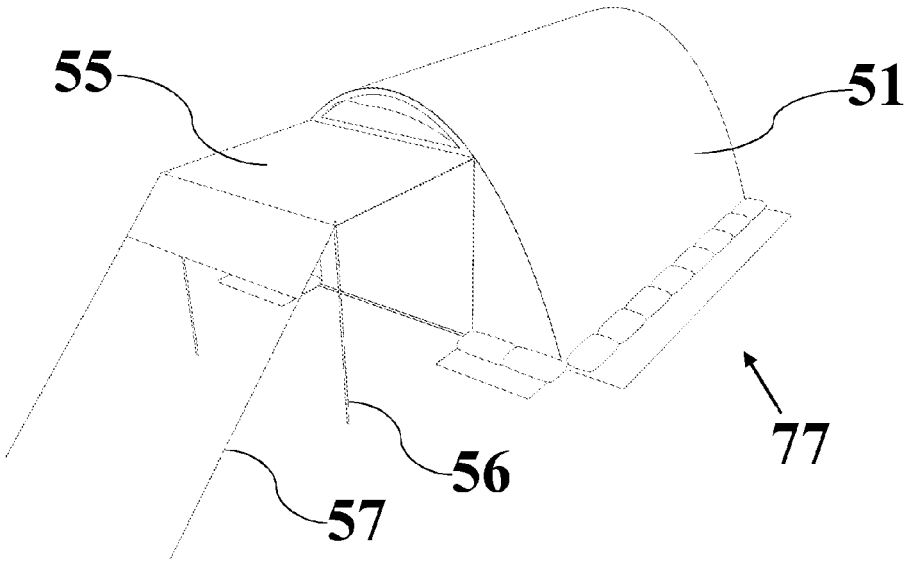

FIG. 53 illustrates a shelter 40 covered with a tarpaulin 51 stretched in the transverse direction 2 and a raised opening 55 held up by poles 56 and rope 57.

Figure 54:
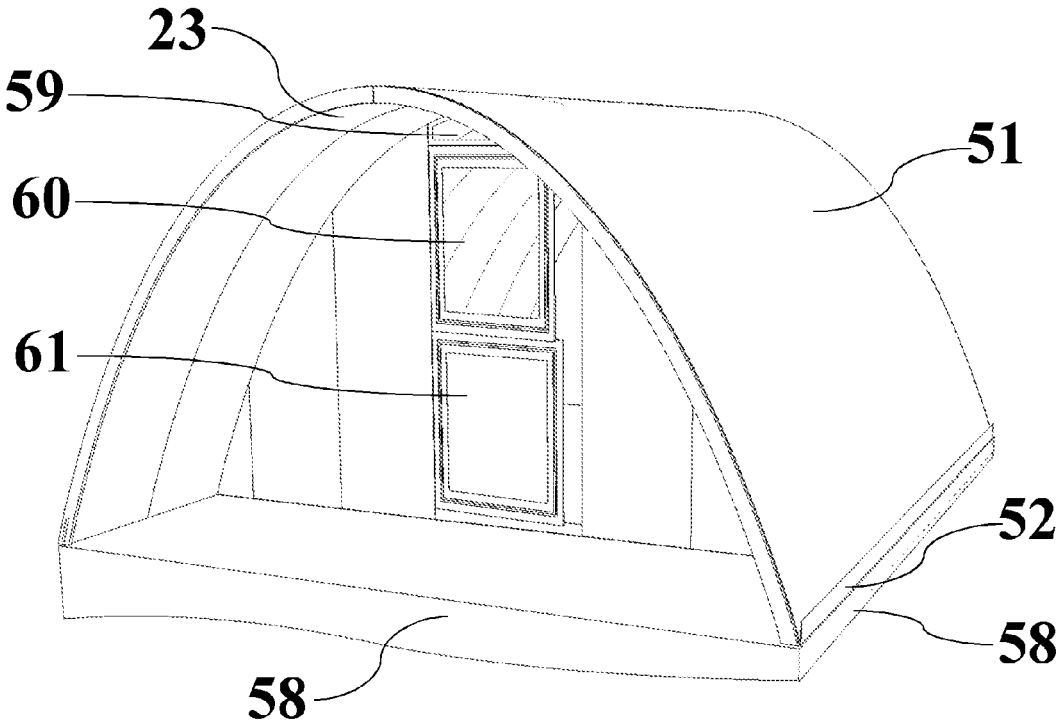

FIG. 54 illustrates a shelter 40 placed on a base 58 and covered with a tarpaulin 51 stretched in the transverse direction 2. End flaps 52 of the tarpaulin can be secured to the base 58. The wall in the transverse direction has been equipped with a ventilation-unit 59 and a door with a lower part 61 and a upper part 60 that can open separately.

Figure 55:
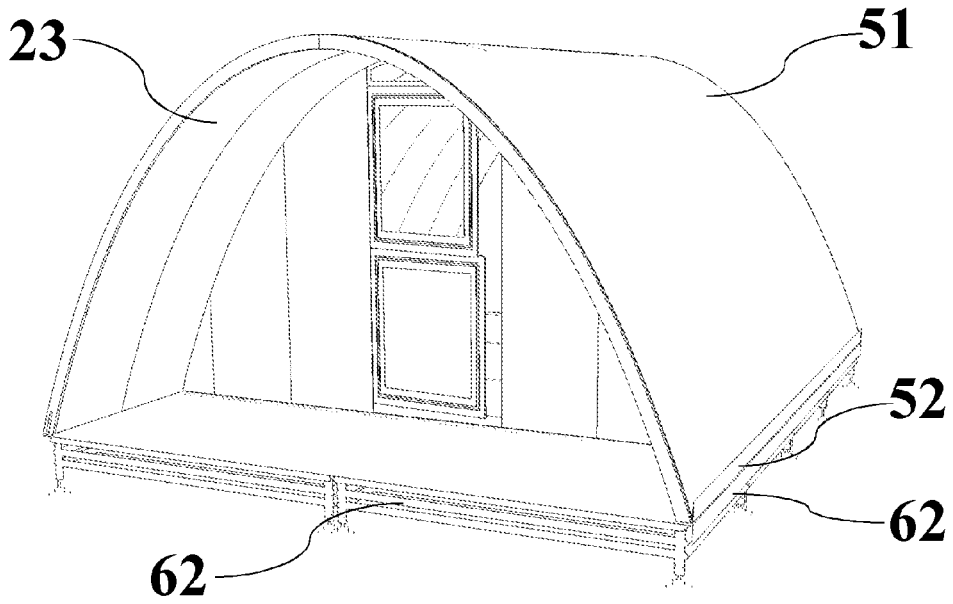

FIG. 55 illustrates a shelter 40 placed on an adjustable plinth 62 and covered with a tarpaulin 51 stretched in the transverse direction 2. End flaps 52 of the tarpaulin can be secured to the adjustable plinth 62. The wall in the transverse direction has been equipped with a ventilation-unit 59 and a door with a lower part 61 and an upper part 60 that can open separately.

Figure 56:
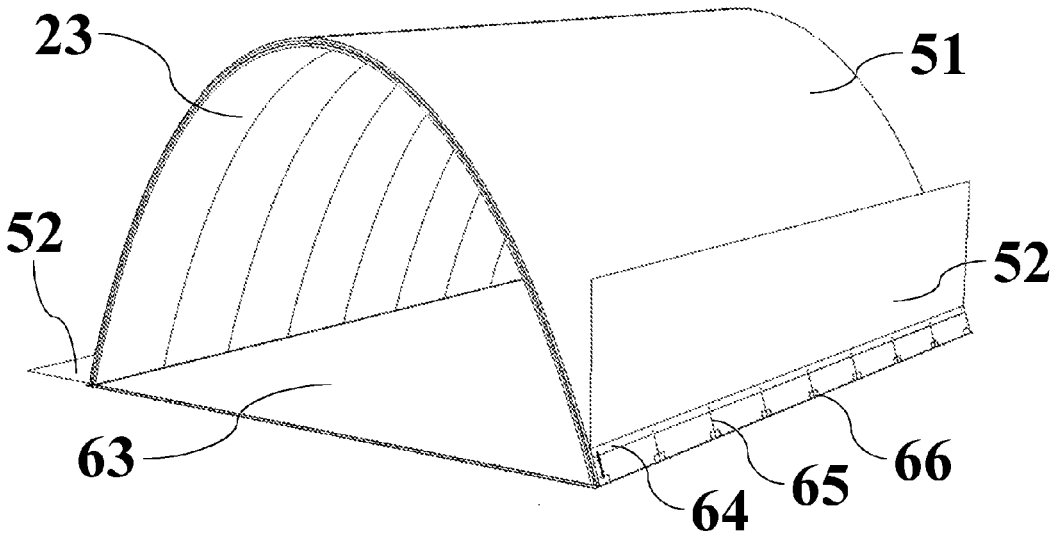

FIG. 56 illustrates a shelter 40 placed on a floor tarpaulin 63 and covered with a tarpaulin 51 stretched in the transverse direction 2. Flaps 64 welded on to the down-side of the tarpaulin 51 are connected to the floor tarpaulin 63.

Figure 57:
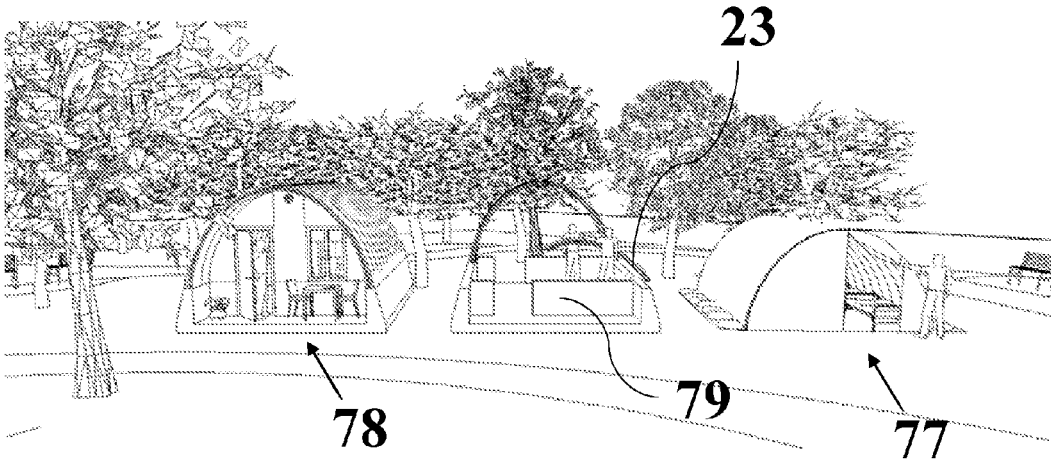

FIG. 57 illustrates three phases of transforming an immediate shelter 77 into a more permanent structure and thereby having the advantage the simplicity of moving the light weight construction-units up on a base 79 to obtain a more permanent dwelling 78.

Figure 58:
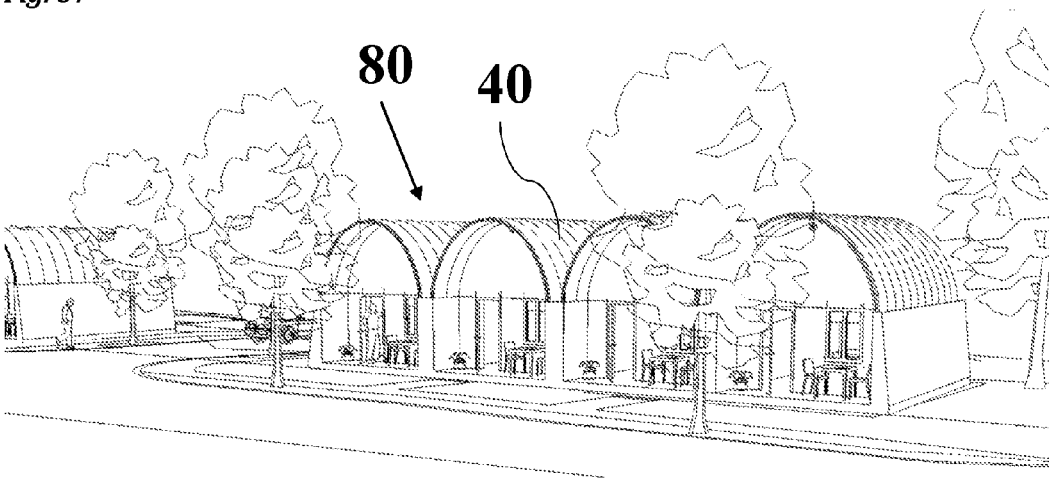

FIG. 58 illustrates how a series of construction-units 40 possibly from immediate shelters 77 are integrated in the roof-structure of two-story terraced houses 79. This makes it possible to obtain well insulated homes.

The invention claimed is:

1. A self-carrying structure to be used for shelter or dwelling which structure comprises two or more construction-units, said construction-units are adapted for being combined with a similar unit to constitute a self-carrying structure to use for a shelter or dwelling, each construction-unit having a sidewall and a roof extending therefrom, the units together defining an arched span of a weight of less than 75 kg, a plurality of holes in the units, a tension bar in at least one of the holes, and a connection comprising one of: a rope, a steel wire or a plate, securing the tension bar within the respective hole.

2. The self-carrying structure according to claim 1 wherein at least one of said construction-units has a volume and wherein at least 30% of the volume of the construction-unit consists of light-weight polymers.

3. The self-carrying structure according to claim 1, wherein at least one of said construction-units comprises light-weight polymers, comprising Expanded Polystyrene (EPS), Extruded Polystyrene (XPS) and/or Polyurethane.

4. The self-carrying structure according to claim 1, wherein at least one of said construction-units has a coating that comprises either polymer, metal, reinforced cement or roofing felt.

5. The self-carrying structure according to claim 1, wherein at least one of the construction-units includes a tongue or groove that fits into holes, grooves or dents in a side of another of the construction-units.

6. A self-carrying structure according to claim 1, wherein the holes in the construction-units are precast.

7. The self-carrying structure according to claim 1, wherein the construction-units include a frame or a band that is configured and operable to fix a lowest part of the construction-unit and is also able to be fixed on to a foundation, plinth or a wall.

* * * * *